US005172613A

United States Patent [19]

Wesch, Jr.

[11] Patent Number: 5,172,613

[45] Date of Patent: Dec. 22, 1992

[54] POWER TONGS WITH IMPROVED GRIPPING MEANS

[76] Inventor: William E. Wesch, Jr., P.O. Box 337, Humble, Tex. 77347

[21] Appl. No.: 760,322

[22] Filed: Sep. 16, 1991

Related U.S. Application Data

[63] Continuation of Ser. No. 447,419, Dec. 19, 1989, abandoned.

[51] Int. Cl.[5] ..... B25B 13/50

[52] U.S. Cl. ..... 81/57.33; 81/57.11; 81/57.14

[58] Field of Search ..... 81/57.33, 57.11, 57.14, 81/57.18, 57.2, 57.3, 57.34, 57.35, 421–424, 424.5, 186; 279/106, 20

[56] References Cited

U.S. PATENT DOCUMENTS 3,196,717 7/1965 Sheppard ..... 81/57.2
4,060,014 11/1977 Turner ..... 81/57.2
4,346,629 8/1982 Kinzbach ..... 81/57.2
4,437,363 3/1984 Haynes ..... 81/57.2
4,869,137 9/1989 Slator ..... 81/57.18

*Primary Examiner*—Bruce M. Kisliuk
*Assistant Examiner*—Lawrence Cruz
*Attorney, Agent, or Firm*—Jack A. Kanz

[57] ABSTRACT

Power tongs and the back-ups are disclosed which have improved means for gripping pipe and tubular members. Torque is applied and held with minimum damage to the pipe or tubular member. A plurality of gripping assemblies, each consisting of a pivoted jaw having a friction surface, are mounted on a drag ring. Rotational resistance is selectively applied to the drag ring to cause the jaws to make contact with or be released from the pipe prior to any torque being applied to the pipe. Various modifications of the gripping assemblies are disclosed to provide better gripping contact with the pipe.

63 Claims, 9 Drawing Sheets

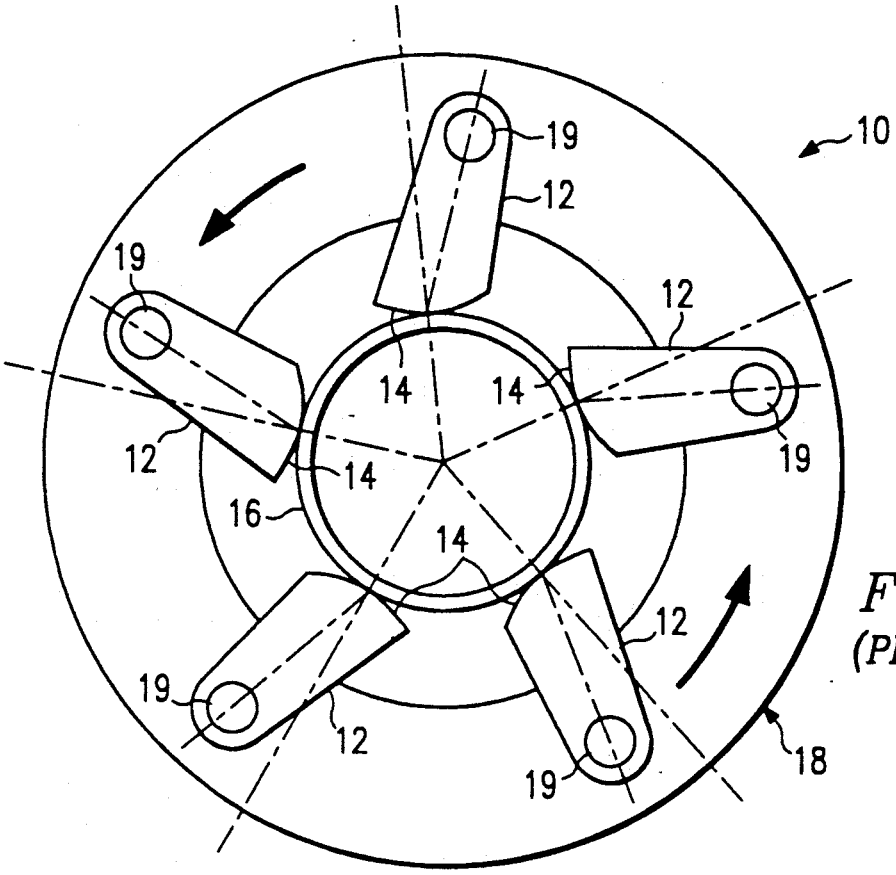
FIG. 1b
(PRIOR ART)
FIG. 1c
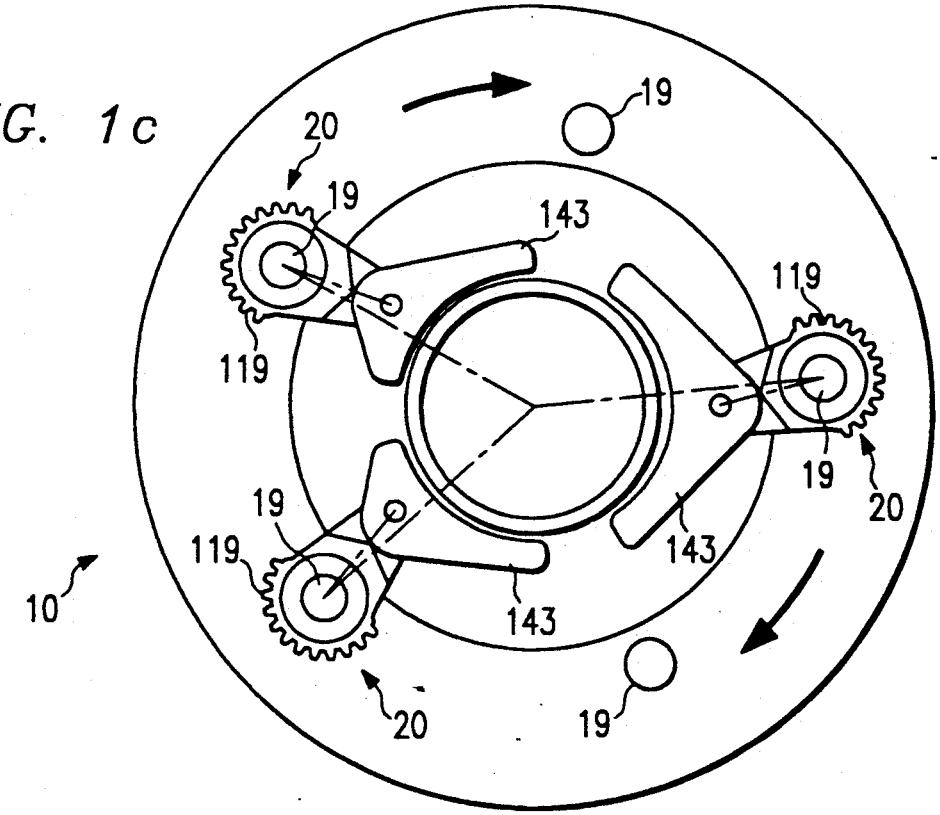

POWER TONGS WITH IMPROVED GRIPPING MEANS

This is a continuation of application Ser. No. 07/447,419 now abandoned filed Dec. 7, 1989 entitled Power Tongs With Improved Gripping Means, now abandoned.

TECHNICAL FIELD

This invention relates to power tongs and back-ups which have improved apparatus for gripping pipe and tubular members in general. More specifically, it relates to power tongs in which the gripping apparatus minimizes deformation and damage to the tubular member caused by jaws gouging or sliding along the surface of the tubular member.

BACKGROUND AND SUMMARY OF THE INVENTION

Power tongs are devices used to secure together ("make up") and detach ("break out") threaded ends of two adjacent tubular products such as pipe sections by gripping, applying torque to and rotating one of the sections. Other devices known as back-ups are often used in conjunction with such tongs to grip and hold against rotation the other of the two adjacent sections of pipe.

In recent years, major oil companies have required their drill string pipes or tubular products to be screwed and torqued together without damage to the tubulars so that stress and corrosion concentrations will not occur in the tubulars in the tears and gouges caused by the tongs and/or back-up teeth. In addition, to maintain integrity of the threaded connection it is desirable to reduce deformation of the pipe by the power tongs and back-ups near the location of the threads, thus allowing more compatible meshing of the threads and reducing frictional wear.

U.S. Pat. No. Re 31,993 (incorporated herein by reference for all purposes) issued on Oct. 1, 1985 as a reissue of U.S. Pat. No. 4,281,535 and describes means to accomplish the task of making and breaking the threaded joints of such tubular members.

The terms "pipe" or "tubular" as used herein shall include tubing and other cylindrical objects.

Gouging and tearing of pipe is caused in some instances by a number of undesirable conditions which cause concentration of the gripping force applied by the tong or back-up. For example, one such condition is insufficient contact area between gripping teeth of the tong or back-up and the pipe. Another is inadequate contact by one or more of a number of gripping members which engage the pipe, causing the gripping force to be concentrated with and applied by the remaining members. Still further, the gripping surface presented to the pipe may not conform in radius to the outer diameter of the pipe, causing uneven distribution of the gripping force across the surface of the pipe and concentrations at drastically reduced contact areas between the pipe and gripping mechanism.

Mis-alignment of the tong or back-up with the pipe may also cause gripping force concentrations leading to pipe damage. If the tong or back-up is not aligned axially with respect to the pipe the gripping surfaces may contact the pipe at an angle, thus causing the gripping force to be applied to the pipe along the edge of a gripping surface, for example. Typically, this damages the pipe because the pressure applied to the pipe is concentrated in the relatively small area of contact between the gripping mechanism and pipe instead of being spread over the entire face of the mechanism.

Considerable wear can also occur as the pipe is engaged by the tong. Many conventional tongs incorporate a gripping assembly including a mounting ring which supports a number of gripping members such as dies and rotates with respect to a drive ring. The gripping members are actuated by rotation of the drive ring to engage the pipe. At the outset of operation, the drive ring rotates to force the gripping members into contact with the pipe surface. However, because the mounting ring is also rotatable, rotation of the gripping members relative to the pipe generally occurs as the members are driven into secure engagement with the pipe. As a result, the gripping members of such mechanisms frequently cause scraping, gouging and marring of the pipe as the members slide across the pipe while being progressively tightened by the drive ring to a frictional stationary grip against the pipe prior to rotation.

At least one prior art device, more fully disclosed in U.S. Pat. No. 3,550,485 issued to J. L. Dickmann on Dec. 29, 1970, employs means for retarding movement of the mounting ring while the gripping members are actuated by the drive ring to engage the pipe. The retarding force applied to the mounting ring, however, must be manually activated and adjusted.

Because the retarding mechanism must be manually readjusted if deactivated, it is typically engaged constantly, even during make up and break out operations. As a result, wear of all associated parts is increased unnecessarily and the longevity of the device is substantially limited. If, on the other hand, the retarding mechanism is deactivated during operations, such devices become inherently inconsistent in the application of retarding force to the mounting ring due to repeated manual readjustment, frequently allowing the gripping members to skid across the pipe (if the retarding force is too low) or causing the gripping members to impact the pipe with too great a force (if the retarding force is excessive). In either case scraping, gouging and marring of the pipe typically results.

In conventional tongs, pressure applied by the gripping jaws is not distributed evenly around the pipe but is applied to areas spaced around the perimeter of the pipe. This causes undue deformation of the pipe as the jaws impinge against its surface. Since the jaws typically grip the pipe adjacent threads in couplings used to secure adjacent pipe sections, the threads deform with the pipe. Such deformation causes leaks across the threads, thereby reducing the useful life of the pipe.

The present invention overcomes these and other disadvantages associated with other tongs, back-ups and similar pipe gripping apparatus. The preferred embodiment is a pipe gripping apparatus for engaging, disengaging and/or rotating pipe sections which have gripping assemblies for gripping a section of pipe without slipping, marring, gouging or tearing the pipe. The gripping assemblies pivotally support a number of jaws. The jaws are actuated into and out of contact with the pipe during make up and break out procedures.

The radial gripping force applied to the pipe by the jaws is proportional to the torque applied to the pipe by the gripping apparatus so that the greater the torque applied, the greater the gripping force exerted by the jaws against the pipe. The surface area of the jaws contacting the pipe is sufficiently great, given the maximum gripping force to be applied to the pipe, to avoid reaching or exceeding the yield strength of the surface of the pipe. The contact surfaces of the jaws may, accordingly, be smooth or equipped with gripping teeth, or the gripping apparatus may incorporate jaws having both types of contact surfaces. The jaws are sized to replace gripping dies on existing state of the art gripping apparatus.

An additional feature of the preferred embodiment is a positioning device between the jaw members and the gripping assembly to which they are connected. This positioning device tends to hold the jaws, once moved to a retracted position out of contact with the pipe, in a position which will not interfere with insertion or removal of the pipe from the gripping apparatus. A further aspect of the invention is incorporation into the jaws of removable jaw sections or segments so that the entire jaw member need not be removed once the gripping teeth become worn or when different sized jaw members would otherwise be required to match pipes having different radii. These segments are configured to seat substantially flush against the pipe member to avoid force concentrations and slippage which would likely damage the pipe.

In one embodiment the jaw segments are attached to the jaw member in a manner allowing a slight play in the jaw teeth segment with respect to the jaw member so that the jaw segment can adjust itself slightly to make a relatively flush fit with the pipe. In one case, the jaw itself has a spherical connection to the gripping assembly which allows a slight pivoting movement of the jaw and its teeth along axes perpendicular to and parallel with the pipe and permits a relatively flush fit. In another embodiment a removable adapter link is coupled between the jaws and the gripping assembly so that adapter links of various sizes can be used to enable the gripping assembly to accommodate different sized pipes. This reduces manufacturing costs which would otherwise be needed for replacement jaw links and jaw members.

An additional feature is the provision of an adjustable drag on the drag ring to which the gripping assemblies are pivotally mounted. A drag force is applied to the drag ring to prevent it from rotating as the drive ring rotates to force the jaw members into engagement with the pipe. This causes the jaw members to grip the pipe with a predetermined radial force prior to the pipe being rotated. This effectively eliminates scraping, gouging and marring of the pipe which would otherwise be caused by slippage of the jaws over the pipe surface.

Projecting lugs are used on certain embodiments to position the jaws out of the way of the pipe when the jaws are retracted and rounded corners may be formed on the jaws to minimize damage caused by the jaw contacting the pipe on the edge of a gripping surface.

Another embodiment of the invention is an open throat tong utilizing three gripping assemblies rather than the two assemblies typically used by prior art devices. This causes the force applied to the pipe to be more uniformly distributed about the circumference of the pipe, distributes the force within the tong or backup more evenly, lessens the force applied at any one point, and allows the associated jaws to more fully encircle the pipe. Jaws such as those previously discussed are pivotally mounted to the gripping assemblies.

The present invention also contemplates the use, in the alternative, of a special jaw link member pivotally coupled to the interface assembly. The link member has on one end a pivotal jaw and on the other end a jaw segment, both of which allow for misalignment and wear and provide a gripping surface for covering more of the pipe surface.

BRIEF DESCRIPTION OF THE DRAWING

For a more complete understanding of the present invention and the advantages thereof, reference is now made to the following description taken in conjunction with the accompanying drawing in which:

FIG. 1*b* is a partial top view of a prior art closed face tong incorporating conventional dies to grip a section of pipe;

FIG. 1*c* is a partial top view of the tong shown in FIG. 1*b* in which jaws incorporating the present invention are substituted, for the conventional dies;

DESCRIPTION OF THE INVENTION

Figure 1A:
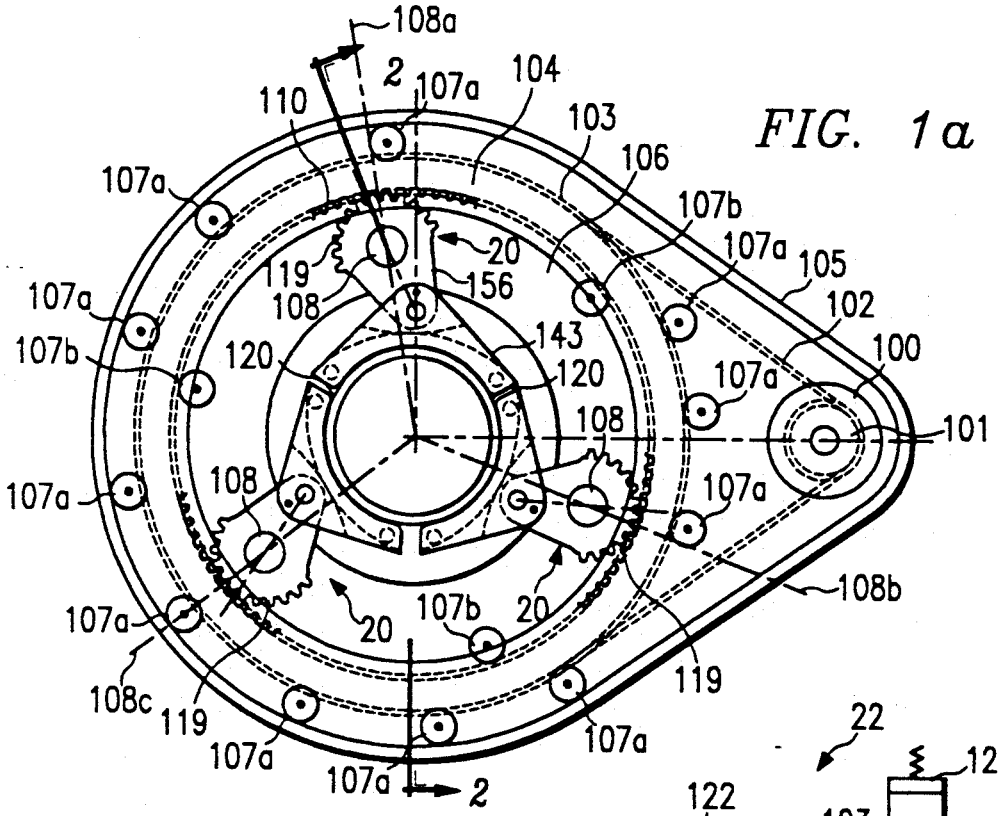
FIG. 1*a* is a top view of a closed face power tong unit.

FIG. 1*a* is a top view of a closed face tong unit illustrating a preferred embodiment of the invention. A conventional drive system using fluid motor 100 to drive sprocket 101 causes roller chain 102 to turn sprocket 103 forming part of final drive gear or ring 104. Drive gear 104 rotates within housing 105 on cam rollers 107*a* (some of which are shown in FIG. 1*a*) attached to housing 105 around the periphery of final drive gear 104. Drag ring 106 rotates concentrically within final drive gear 104 on cam rollers 107*b* (some of which are shown in FIG. 1) attached to final drive gear 104 around the periphery of drag ring 106. Final drive gear 104 is concentric with the tubular surface of pipe 120. Drag ring 106 has a plurality of pins 108 which may or may not be equally spaced around drag ring 106. Three equally spaced pins 108 are preferred. Pins 108 may contain grease fittings 109.

A plurality of gripping assemblies 20 (or 21 of FIGS. 3 and 4: or 26 of FIGS. 13, 14 and 14*a*: or 28 of FIGS. 15 and 16) fit over pins 108, engaging gear teeth 110 on final drive gear 104. Each gripping assembly includes a jaw 143 pivotally connected to a jaw link 156 pivotally connected at pin 108 to drag ring 106.

In the embodiment shown in FIG. 1*a*, the gripping assemblies 20 should maintain substantially identical rotational positions with respect to the center of the pipe 120. This ensures that the gripping assemblies 20 will grip the pipe 120 at a location substantially at the center of rotation of the final drive gear 104. Proper relationship of pins 108 to drive gear teeth 110 is illustrated in FIG. 1*a* by lines 108*a*–108*c* which intersect the center of the pipe 120, intersect the center of the pin 108 and bisect a tooth of gear 110. Gear teeth 119 of each gripping assembly 20 mesh with gear teeth 110 of final drive gear 104 to position each of the gripping assemblies 20 substantially identically relative to their respective lines 108*a*–108*c* and to pipe 120 as final drive gear 104 rotates.

Figure 3:
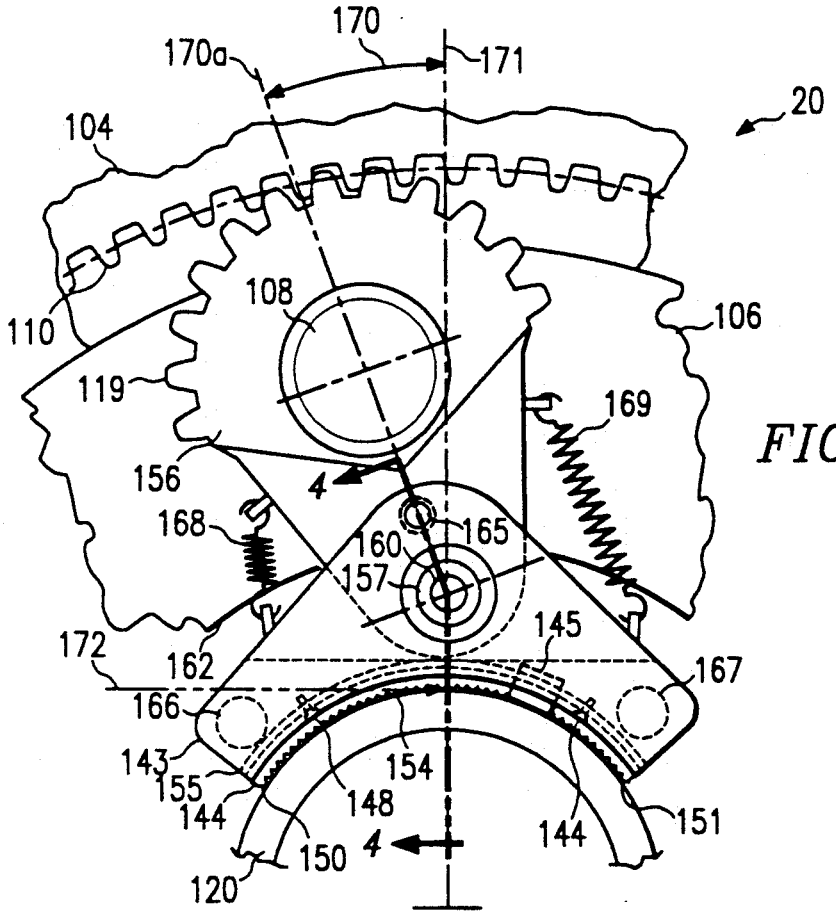
FIG. 3 is a side view of a preferred jaw assembly.

FIG. 3 illustrates a preferred means of properly positioning the gripping assemblies 20 (only one shown) with respect to the pipe 120. The components of the gripping assembly 20 are arranged so that a center line 170*a* passes through the center of pin 108, passes through the center of jaw pivot pin 157 and bisects a space between teeth 119 of each assembly 20. This relationship applies to all other gripping assemblies disclosed herein for use with tongs having similar final drive gears with internal teeth.

FIG. 1*b* illustrates a prior art closed face tong 10 incorporating five gripping dies 12 spaced substantially equally about the perimeter of the tong 10. The dies 12 each have convex gripping surfaces 14 which engage a pipe section 16 inserted into the tong 10. The dies 12 are pivotally supported on a mounting ring 18 by a pivot pin 19.

It will be apparent that the prior art tong 10 has an inherent propensity to mar, gouge and tear the surface of the pipe 16. Specifically, the convex surfaces 14 of each gripping die 12 contact the pipe 16 only along a relatively small area, thereby concentrating the gripping force in many instances beyond the yield strength of the surface of the pipe 16. In addition, the use of five gripping dies 12 often results in uneven gripping forces being applied by the dies 12 to the pipe 16 since the gripping surfaces 14 of the dies 12 frequently wear unevenly. This further concentrates the gripping force with the gripping dies 12 more fully contacting the pipe 16, thus increasing damage to the pipe 16. Moreover, the relatively small contact area between the gripping dies 12 and the pipe 16 requires a relatively larger gripping force to be asserted against the pipe 16 to avoid slippage, thereby contributing to damage of the pipe 16.

FIG. 1*c* illustrates an arrangement of three (3) gripping assemblies 20 substituted for the five gripping dies 2 of the prior art tong 10. This is accomplished by removing the dies 12 and inserting three of the assemblies 20 on three of the five pivot posts 19. Pivotally mounted on each of the gripping assemblies 20 is a jaw 143 for engaging and gripping pipe 16. Because no three of the posts 19 are spaced evenly about the tong 10, the jaws of the assemblies 20 are sized accordingly in this application to maintain separation in operation and also to engage the pipe 16 along substantially all of its perimeter. The gear teeth 119 of the assemblies 20 are driven by a drive gear (not shown) of the tong 10 in the same way as prior art dies 12 to engage, disengage and apply torque to the pipe 16. It will be apparent that gripping assemblies 21, 24, 26 and 28 (discussed in detail herein), with appropriately sized jaws, can also be similarly incorporated in the prior art tong 10 in place of the gripping dies 12.

Figure 2:
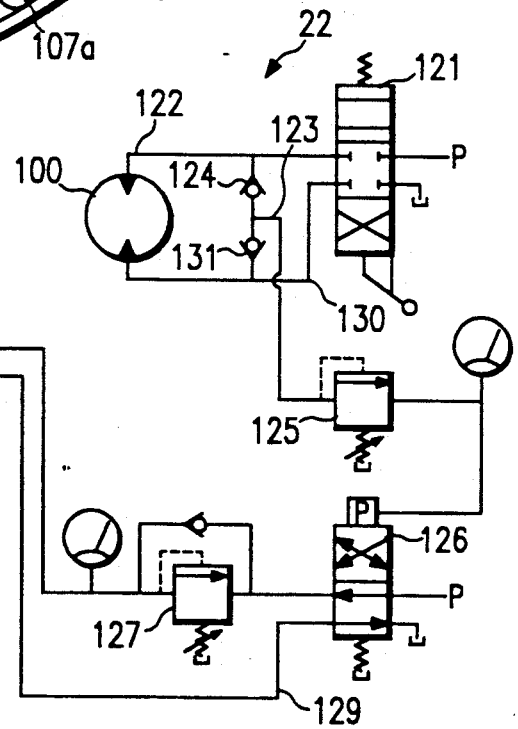
FIG. 2 is a partial cross-sectional view taken along section lines 2—2 of FIG. 1*a* illustrating two alternative embodiments for applying friction to the drag plate to cause the jaws to engage the pipe with a predetermined radial pressure before rotation of the pipe begins.
Figure 2:
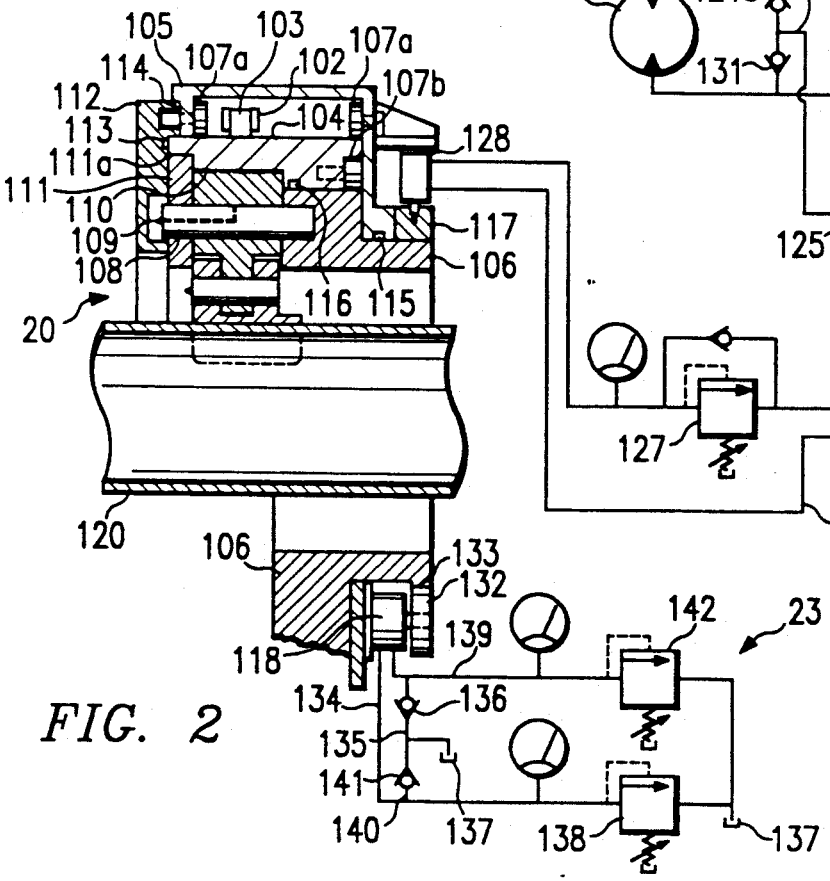

FIG. 2 is a partial cross-sectional view of the closed face tong unit taken along lines 2—2 of FIG. 1*a* in which pivot posts 108 are spaced substantially equally about the perimeter of the tong. Cover plate 111 fits over pins 108 and into slot 111*a* of final drive gear 104 to retain assemblies 20 and to provide additional support, along with drag ring 106, for radial loads produced by the gripping assemblies. Cover plate 111 is retained by removable housing plate 112 which contains grease seals 113 and 114. Seals 113, 114, 115 and 116 keep grease within the tong housing 105.

Gripping assemblies 21, 26 and 28 can also be substituted for assemblies 20 in the tong of FIG. 2 as alternative embodiments. The following discussion of the construction and operation of the tong of FIG. 2 generally applies to the embodiments incorporating assemblies 21, 26 and 28.

In operation, assuming the gripping assemblies 20 (or 21, 26 or 28) to be in the retracted position, final drive gear 104 is rotated clockwise by motor 100. The rotation of drag ring 106 is resisted by either the fluid friction assembly 22 illustrated at the top of FIG. 2 or with a fluid motor assembly 23 illustrated at the bottom of FIG. 2. Either assembly allows the amount of rotational resistance of drag ring 106 to be controlled. When final drive gear 104 is rotated clockwise, internal gear teeth 110 are engaged with jaw gear teeth 119 causing gripping assemblies 20 to rotate clockwise toward the tubular surface of pipe 120 as illustrated in FIG. 1*a*. Drag ring 106 will not rotate until a predetermined rotational resistance determined by either assembly 22 or 23 is overcome by torque on final drive gear 104. This allows the gripping assemblies 20 to be rotated clockwise (FIG. 3) causing each gripping jaw to move inwardly to engage the tubular surface of pipe 120.

Conversely, when final drive gear 104 is rotated counterclockwise the gripping assemblies 20 are rotated counterclockwise and the gripping jaws 143 move outwardly away from the tubular surface of pipe 120 and are completely retracted. The amount of predetermined rotational resistance on drag ring 106 determines the radial preload or force of assemblies 20, 21, 26 or 28 on the tubular surface of pipe 120 before the drag ring 106 is allowed to turn and apply torque to pipe 120. The predetermined force is sufficient to prevent movement of the jaws relative to the pipe as the pipe is rotated. This prevents teeth skid marks on the pipe formed by scraping, gouging, etc., since the pipe will not rotate or be moved until the predetermined preload pressure has been applied to the pipe. Pipe 120, of course, may also be a coupling or other tubular or solid object and such are included herein.

Resistance assembly 22 provides resistance to drag ring 106 by the use of fluid power as shown in the upper portion of FIG. 2. The resistance assembly 22 can be used in conventional and other prior art tongs, in addition to the embodiment disclosed herein, to control gripping and release of the pipe. When fluid motor 100 (the drive motor in FIG. 1*a*) is activated by valve 121 in one direction with fluid pressure in line 122, line 123 is also pressurized through check valve 124. Sequencing valve 125 is adjusted so that the fluid pressure applied to motor 100 will reach a predetermined amount of pressure (which determines torque) before valve 125 opens to allow pressure to actuate pilot operated valve 126. Pilot valve 126, when activated, allows pressure from source P to be coupled to line 129 which causes fluid cylinder 126 to retract and release brake shoe 117 from drag ring 106 so that drag ring 106 can rotate.

When control valve 121 is in the position shown, motor 100 is not activated and the pressure through the lower portion of pilot valve 126 is coupled to adjustable sequencing valve 127. Valve 127 controls the force of the fluid applied to cylinder 128 coupled to brake shoe 117 on drag ring 106. Pilot valve 126 may also operate brake bands (not shown) on the drag ring 106. Thus, a predetermined frictional force is applied to drag ring 106 through brake shoe 117 to resist rotation of drag ring 106.

When control valve 121 is reversed, pressure is applied through line 130 to motor 100 in the opposite direction and line 123 is then pressurized through check valve 131. Again, when a predetermined pressure is reached, sequencing valve 125 operates valve 126 and the brake shoe is released as described earlier. Thus when pressure is first applied through control valve 121 to motor 100 to rotate it in either direction, pressure through pilot valve 126 is holding the brake shoe 117 against drag ring 106 and prevents it from rotating. As the fluid pressure driving motor 100 builds up or increases, a point is reached at which valve 125 opens. This operates pilot valve 126 to cause the fluid pressure to reverse directions through cylinder 128 and release brake shoe 117 from the drag ring 106, thus allowing the drag ring 106 to turn. In such case (while drag ring 106 is stationary) the drive ring 104 is turned to move the gripping assemblies 20, 21 into or out of contact with the tubular surface of pipe 120. When a certain predetermined radial gripping pressure on the pipe 120 is reached (as determined by the pressure setting of sequencing valves 125 and 127) the brake shoe 117 is released and drive ring 104 causes drag ring 106 to turn and rotate pipe 120.

It will be noted that when the motor 100 turns in a direction to cause the gripping assemblies to be moved away from the surface of pipe 120, the gripping assemblies are moved completely away from the pipe 120 before brake shoe 117 is released (as determined by the pressure setting of sequencing valves 125 and 127) and drag ring 106 begins to turn. This protects the surface of pipe 120 from being scratched or scraped by the teeth on the gripping assemblies. Further, this action moves the gripping assemblies out of the path of any subsequent axial movement of the pipe 120 such as occurs upon removal or insertion of a pipe. In like manner, when the motor 100 drives the drive ring 104 clockwise to force the gripping assemblies against the surface of pipe 120, drag ring 106 cannot rotate until the gripping assemblies are in contact with the tubular surface of pipe 120 with a predetermined radial pressure. Then drag ring 106 will rotate the pipe 120, thus preventing the gripping assembly teeth from slipping on the surface of pipe 120 and causing damage. It can be seen that the drag ring 106 remains in a fixed position until the gripping assemblies have been completely removed from or are in contact with the surface of pipe 120 with a sufficient predetermined radial force to protect the pipe from damage.

The preferred method of providing the rotational resistance to drag ring 106 is by use of fluid power assembly 23 illustrated at the bottom portion of FIG. 2. Fluid power assembly 23 can also be used in conventional and other prior art open and closed face tongs. Fluid motor 118 (preferably a vane type fluid motor) has a gear 132 which engages a gear 133 on drag ring 106. When torque is applied in one direction to drag ring 106 by drive gear 104, motor 118 attempts to rotate and therefore acts as a pump to pressurize line 134. Feed fluid for motor 118 feed is provided through check valve 136 and line 135 from fluid reservoir 137. Motor 118 cannot rotate until it pressurizes line 134 to a predetermined pressure as determined by adjustable fluid relief valve 138. Thus, drag ring 106 cannot rotate until motor 118 rotates and motor 118 cannot rotate until it creates sufficient pressure in line 134 to exceed the pressure setting of relief valve 138. Relief valve 138 is adjustable to control the torque required to rotate motor 118 and, by controlling the torque of motor 118, the rotational resistance of drag ring 106 is also controlled.

When torque is applied to drag ring 106 in the opposite direction, motor 118 is rotated in the opposite direction pressurizing line 139 and creating suction through line 140 and check valve 141. When a preset pressure determined by relief valve 142 is reached, valve 142 opens and motor 118 is allowed to turn, thus removing the resistance to drag ring 106 and allowing it to turn at a predetermined torque.

Fluid power assembly 23 provides a constant resistance to rotation of drag ring 106 during the interval of time in which the gripping assemblies are making or breaking contact with the surface of pipe 120. This assures that gripping assemblies 20, 21 or 26 will be held tightly against, or completely released from, the surface of pipe 120 before beginning to rotate, thus preventing slippage of the gripping assemblies on the tubular surface and causing scrape, scratch or gouge marks and the like. Therefore, fluid power assembly 23 provides the same advantages as the fluid friction assembly 22.

Figure 4:
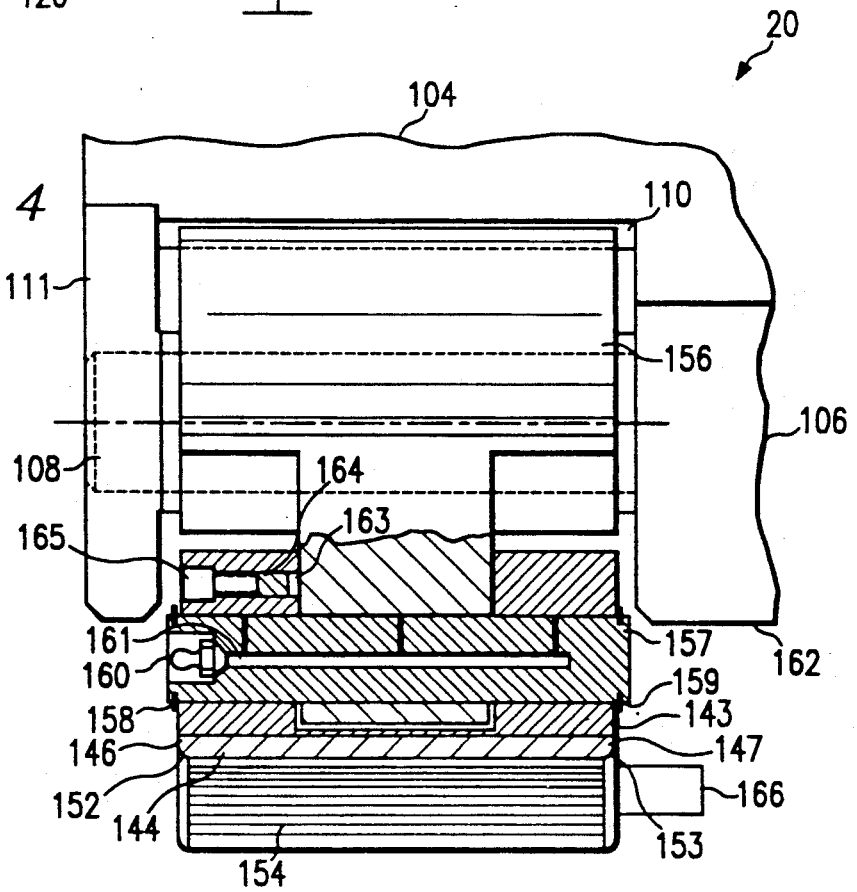
FIG. 4 is a cross-sectional view of the jaw assembly taken along section lines 4—4 of FIG. 3.

FIG. 3 is a side view and FIG. 4 is a cross-sectional view of the gripping assembly 20 of FIG. 3. Gripping assembly 20 consists of a jaw 143 having a removable jaw insert 144 between the surface of pipe 120 and jaw 143. Insert 144 is fitted over dowel 145 (which is part of jaw 143) to secure the insert 144 against torque forces which will occur between jaw 143 and jaw insert 144. Jaw insert 144 is aligned by the sides 146 and 147 of jaw 143 and secured by screws 148 and 149. It will be noted that jaw insert 144 has rounded corners 150, 151, 152 and 153 to prevent jaw teeth 154 from damaging the tubular surface of pipe 120 during engagement thereof. In some cases a shim 155 may be used to compensate for wear of assembly 20 and pins 108 and 157. Also, by providing shims 155 having a gripping surface with a radius that varies from shim to shim, a different force angle 170 can be created merely by inserting a shim 155 having the proper radius. Moreover, shims of appropriate radius may also be used to maintain a flush seat against pipes of different outer diameters.

Jaw 143 is rotatably mounted to jaw link 156 by a pin 157 secured by snap rings 158 and 159. Lubricating means are provided by grease fitting 160 and passage 161. If preferred, jaw teeth 154 may be cut directly into jaw 143 with no jaw insert 144 being used.

To balance forces applied by the jaw 143 to the pipe 120, the pin 157 of the assembly 20 may be positioned at a location on jaw 143 other than that shown in FIG. 3. A similar adjustment can be made, as desired, to the pivot points of the jaws of assemblies 21, 26 and 28.

Jaw link 156 is pivotally mounted on drag ring 106 by pin 108. Gear teeth 119 of jaw link 156 engage internal teeth 110 of final drive gear 104. When final drive gear 104 is rotated clockwise drive gear teeth 110 engage jaw link gear teeth 119 causing jaw link 156 to rotate clockwise about drag ring pin 108. Torque resistance applied to drag ring 106 by either drag assembly 22 or 23 prevents movement of drag ring 106, causing jaw link 156 to urge jaw 143 radially inwardly into engagement with the tubular surface of pipe 120. The amount of drag on drag ring 106 is preset through drag assembly 22 or 23 and determines the amount of preload torque of jaw 143 on the outer surface of pipe 120 before actual torquing of pipe 120 begins. Thus, the outer surface of pipe 120 is protected from damage by the jaw teeth.

When the final drive gear 104 is rotated in the opposite direction, jaw 143 is retracted from the pipe 120 in reverse order of the procedure set forth above.

It will be seen that the drag assemblies 22 and 23 prevent the drag ring 106 and the jaws 143 from turning until the gripping surface teeth are in or out of contact with the surface of pipe 120, thereby protecting the outer surface of pipe 120.

Other improvements are also shown in FIG. 3 with respect to gripping assembly 20. When jaw 143 is retracted and free of contact with pipe 120, it tends to pivot freely about jaw pin 157 and thus may not retract evenly. If it retracts unevenly, pipe 120 may not be able to slip axially into the inside diameter 162 of drag ring 106. If jaw 143 is pivoted about pin 157 such that either outer end of jaw 143 containing lug 166 or 167 protrudes toward the interior of the area to be occupied by pipe 120, pipe 120 (when axially inserted into the center of the closed face tong) may contact that portion of jaw 143 protruding into the area to be occupied by pipe 120, causing damage to the pipe or preventing pipe 120 from being axially inserted into the closed face tong. The present invention solves this problem with a positioning device in jaw 143 consisting of a dowel 163 urged against jaw link 156 by a spring or an elastomer plug 164 compressed by a set screw 165. The dowel 163, which may be steel or another durable friction material, is used to frictionally control the position of jaw 143. As jaw link 156 rotates jaw 143 away from pipe 120 and toward the inside diameter 162 of drag ring 106, lug 166 or 167 (each extending from a respective outer end of the jaw 143) first encounters the inside diameter 162 of drag ring 106. Continued rotation of jaw link 156 forces jaw 143 to overcome the friction caused by dowel 163 and aligns jaw 143 concentrically with the inside diameter 162 of drag ring 106. Lugs 166 and 167 may be on the opposite side (on the upper surface facing the reader) of jaw 143 from that shown, if desired, so that they engage the inside diameter of cover 111.

Positioning of jaw 143 during retraction from or engagement with pipe 120 can also be controlled by springs 168 and 169. Alternatively, these springs may be torsion springs (not shown) or other suitable resilient members. Each spring is secured between an attachment point on jaw link 156 and an attachment point on jaw 143. The spring tension of spring 168 may be greater than that of spring 169 to hold the jaw 143 in the position shown in FIG. 3 as it is retracted by the counterclockwise rotation of jaw link 156. When the jaw 143 is extended inwardly by the clockwise rotation of link 156, contact of the outer ends of jaw 143 with the pipe 120 will allow the jaw 143 to center itself about the tubular outer surface of pipe 120.

In some cases it is possible that only one spring 168 may be needed to center jaw 143 as indicated.

The radial gripping force of jaw 143 to pipe 120 along radial force line 171 is proportional to the torque applied by final drive gear 104 to the jaw link 156 and is a function of the cosine of force angle 170. The preferred radial force along radial line 171 sufficient to set the jaw teeth on the pipe may be predetermined by multiplying the tangential force 172 at the surface of pipe 120 by a factor of 0.8 through 3.0, inclusive. A ratio of 1.10 is preferred because the radial force preferably exceeds the tangential force by a factor of 0.10 to reasonably assure that the jaw teeth will not skid on the pipe 120. The tangential force 172 is applied torque in inch-/pounds divided by the radius in inches of pipe 120. For any given desired tangential force 172, the resulting force angle 170 can then be computed in degrees. After computing desired radial force to jaw 143, the jaw teeth 154 spacing and length (width of jaw 143) can be computed using radial force 171 so that the force applied by jaw teeth 154 does not exceed the ultimate strength of the material forming pipe 120 at the maximum required torque applied to pipe 120. This eliminates teeth marks on the pipe.

It will be noted that the applied radial load is borne by pins 108 and pins 157. No radial load is carried by final drive gear 104.

Gripping assemblies 20, 21, 26 and 28 may also be used in a tong back-up which creates torque to hold the pipe 120 when torque is applied in the opposite direction by a power tong to an adjacent section of pipe to make or break a connection. In a tong back-up, a roller chain (not shown) may be substituted for final drive gear 104 engaging a sprocket segment (not shown) on jaw link 156 instead of gear teeth 119.

Figure 5:
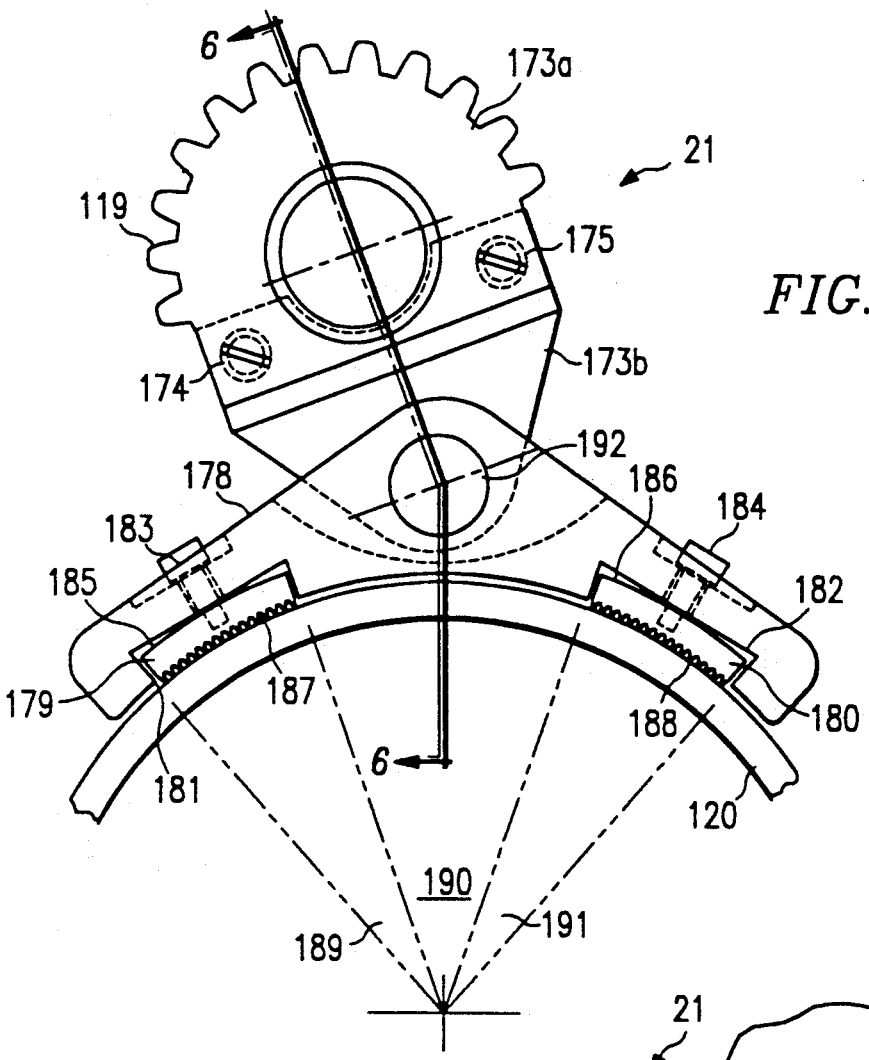
FIG. 5 is a side view of an alternate jaw assembly illustrating removable gripping segments pivotally mounted in the jaw body.
Figure 6:
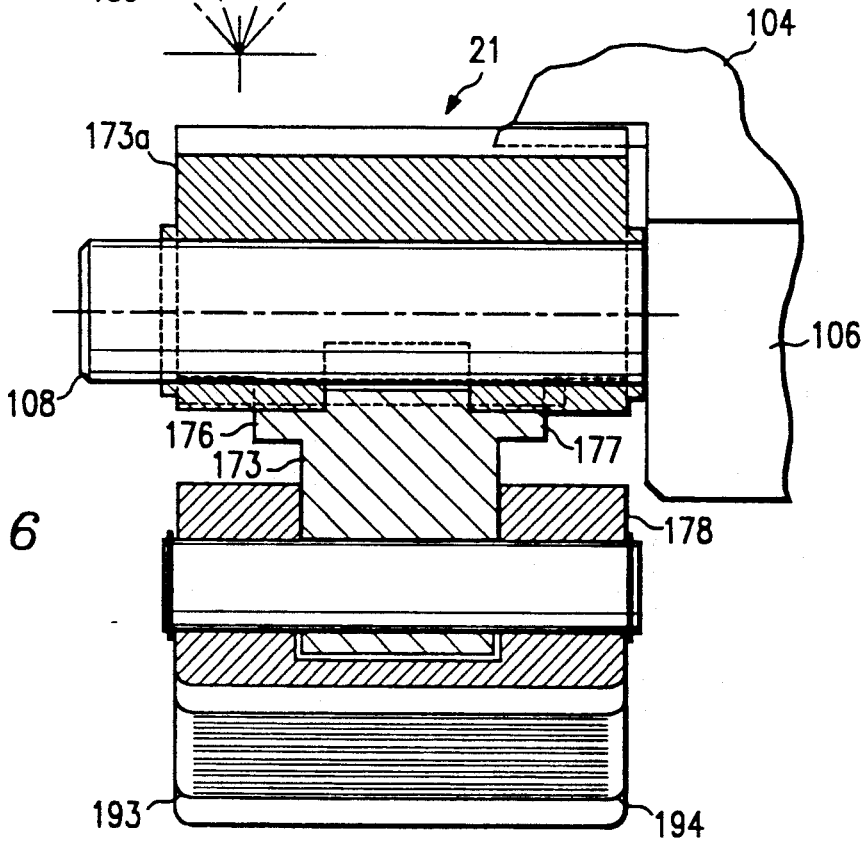
FIG. 6 is a cross-sectional view of the jaw assembly taken along section lines 6—6 of FIG. 5.

FIG. 5 shows an alternate embodiment 21 of a gripping assembly. FIG. 6 is a cross-sectional view thereof. Gripping assembly 21 provides a jaw link in two pieces, a jaw link gear head 173*a* and a jaw link adapter 173*b* which fits in a suitable slot in jaw link gear head 173*a* and is secured by screws 174 and 175. Shoulders 176 and 177 bear the radial load during operation. Jaw link adapter 173*b* is separate from gear head 173*a* and jaw 178. This permits one gear head 173*a* to be used for several different sizes of pipe 120, thereby reducing the cost and effort of substituting gripping assemblies completely to accommodate different sizes of pipe. Thus, if pipe 120 is of smaller diameter link adapter 173*b* and jaw 178 can simply be replaced with a longer adapter and smaller jaw. In like manner, if the radius of pipe 120 is larger link adapter 173*b* and jaw 178 can be replaced with a shorter adapter and larger jaw, thus allowing the device to accommodate the larger diameter pipe.

FIG. 5 illustrates an alternate jaw 178 which facilitates flush engagement of the jaw 178 with various pipe sizes. Jaw segments 179 and 180 are contained within slots or grooves 181 and 182 in jaw 178. They are loosely restrained by screws 183 and 184. The top of slots 181 and 182 are flat, heat treated and relatively very hard (Rockwell C54 to C65). The top of the segments 179 and 180 are hardened and have outer curved surfaces 185 and 186 concentric with pipe 120. The interior arcs defined by the tops of the teeth 187 and 188 are also concentric with the pipe 120. Surfaces 185 and 186 roll on flat surfaces of slots 181 and 182 with enough clearance to self-adjust to fit pipe 120 and overcome minor deviations in fit. Location angles 189, 190 and 191 are predetermined to evenly balance the radial load on pipe 120 imparted by each of the jaw segments utilized by jaw 178 and the segments of other jaws with which it is used. The corner radii 193 and 194 around jaw segments 179 and 180 in FIG. 6 serve to reduce contact marks on pipe 120.

Parts of gripping assembly 20 shown in FIG. 3 may be interchanged with gripping assembly 21. Similarly, the jaw 143 of FIG. 3 and jaw 178 of FIG. 5 may be used on the gripping assemblies of FIGS. 7, 9, 11 and 12.

Figure 7:
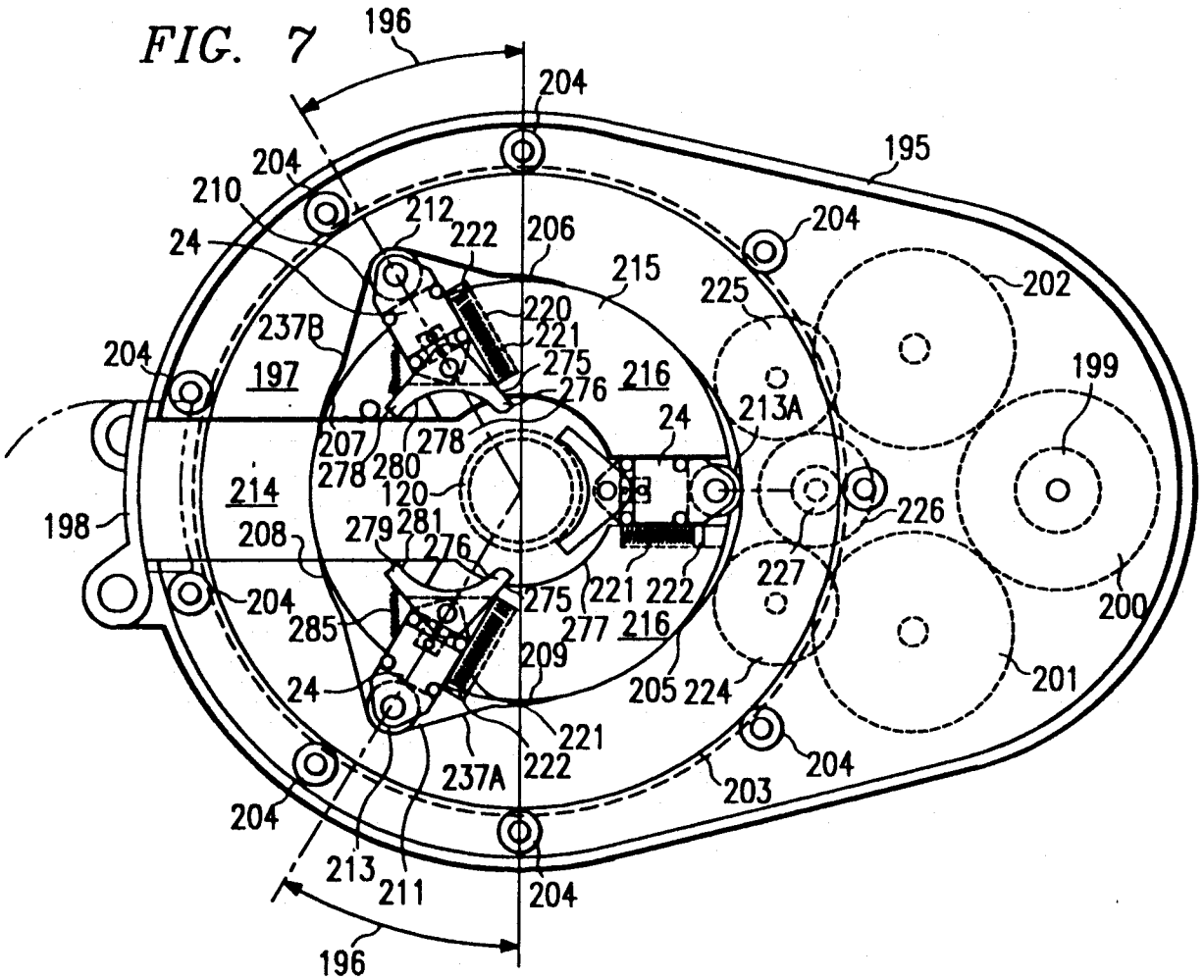
FIG. 7 is a top view of an open throat power tong with the gripping jaws in the open position.
Figure 9:
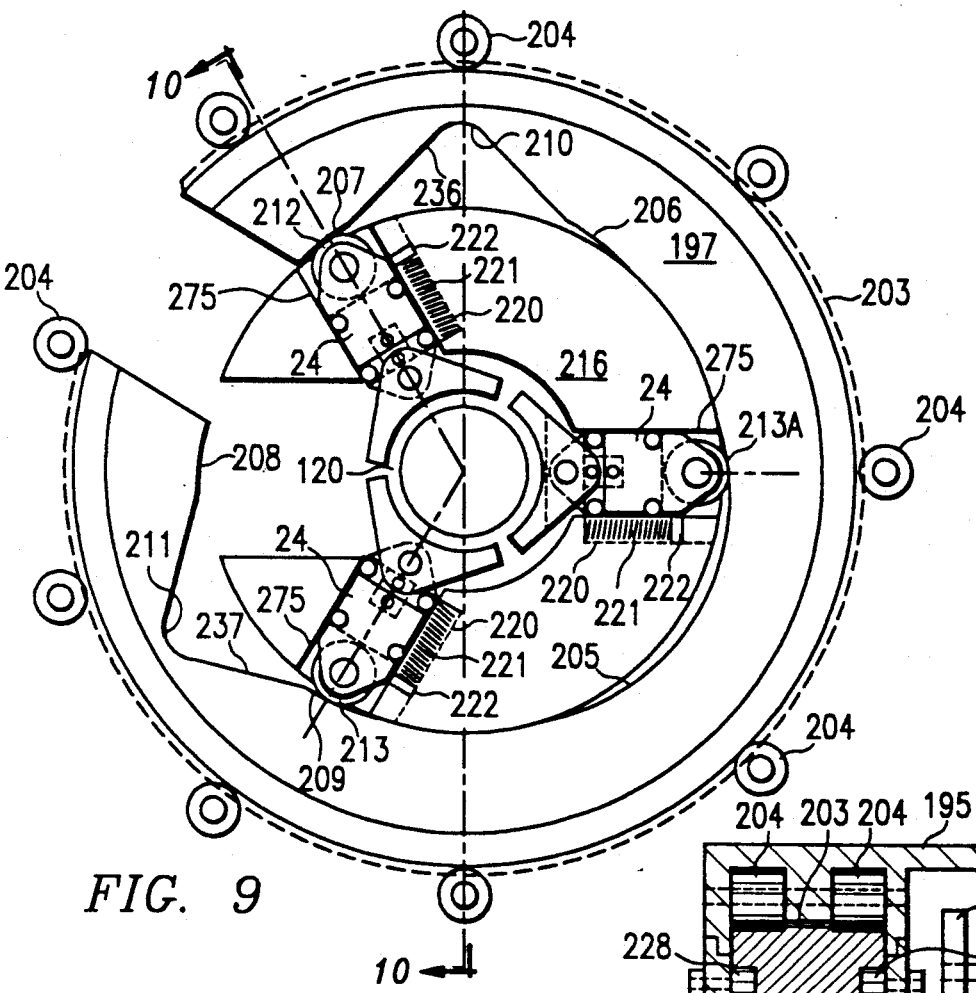
FIG. 9 is a partial top view of an open throat power tong illustrating the gripping jaws in their extended position and engaging the pipe for rotation.

FIGS. 7 and 9 depict an open throat power tong with three gripping assemblies 24. The gripping assemblies 24 are preferably spaced as shown at one hundred twenty degree increments with angles 196 being thirty degrees. This spacing is preferred so that radial loads are equally distributed on the three gripping assemblies 24 and about the drive ring 197. However, it should be noted that the gripping assemblies 24 may be located such that angles 196 are from zero to forty-five degrees, if desired.

A major advantage of the embodiment shown in FIG. 7 over the prior art open throat tongs is that in prior art tongs the radial load is divided between only two jaws while the arrangement shown in FIG. 7 and in FIG. 9 allows the radial load to be generated by three gripping assemblies 24, thus reducing the radial load applied by each jaw. Further, this arrangement (which separates radial loads into three parts spaced apart approximately 120 degrees) reduces and distributes stress on the final drive gear 197, thereby minimizing breakage of the drive gear. In addition, the three gripping assemblies 24 as shown have sufficient arcuate length to substantially completely encircle pipe 120, thus minimizing damage to the surface of the pipe 120 and reducing deformation.

Conventional hinged gate 198 is openable to allow radial entry and exit of pipe 120. Gate 198 is closed during torquing of pipe 120. The gate 198 may be manually operated or power operated. It may have a mechanical latch (not shown) to resist radial stress on housing 195 during torquing of pipe 120.

Final drive gear 197 is driven by conventional gearing of a motor 199 with a drive gear 200 which drives gears 201 and 202. Final drive gear 197, in turn, is driven by gears 201 and 202 through gear teeth 203. Final drive gear 197 rotates within housing 195 on a plurality of rollers 204 secured to housing 195.

Figure 10:
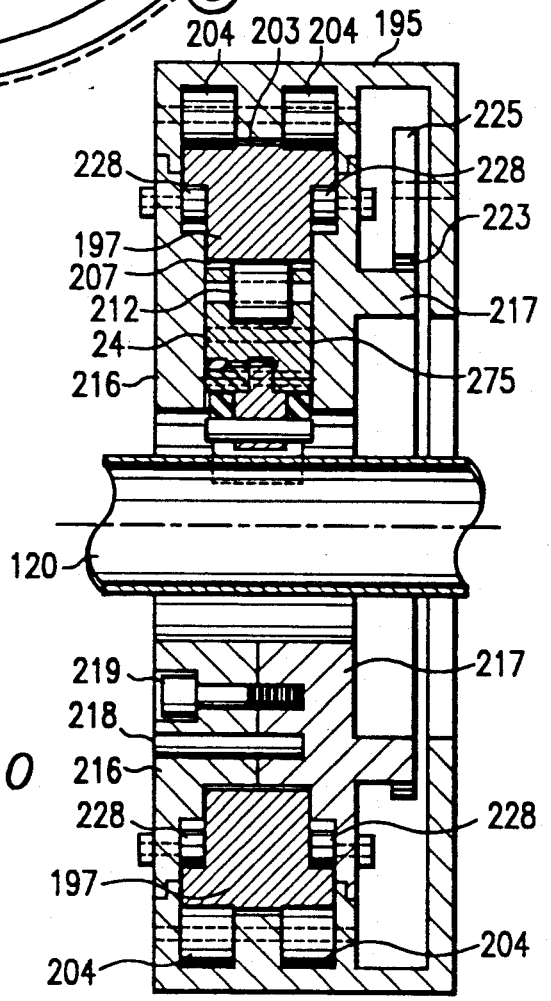
FIG. 10 is a cross-sectional view of the open throat power tong taken along section lines 10—10 of FIG. 9.

The final drive gear 197 contains conventional cam surfaces 205, 206, 207, 208 and 209 (these may be either flat or arcuate, as desired) which cooperate with the three gripping assemblies 24 to grip pipe 120. The relief areas 210 and 211 in final drive gear 197 allow gripping assembly rollers 212 and 213 to retract and move the jaw assemblies sufficiently outwardly to allow pipe 120 to be radially inserted into and out of throat area 214. Drag ring 215 is preferably made in two parts, 216 and 217, secured together by dowels 218 and bolts 219 as is best shown in FIG. 10.

Radial passageways 275 allow gripping assemblies 24 to slide inwardly toward and outwardly away from the center of pipe 120. Grooves 220 contain springs 221 which exert force on lugs 222 on gripping assemblies 24 and urge gripping assemblies 24 radially outwardly at all times. Drag ring 215 turns concentrically within drive gear 197 on rollers 228. As shown in FIGS. 7 and 10, drag ring 215 has a gear 223 on part 217 which engages gears 224 and 225 to drive gear 226.

Figure 8:
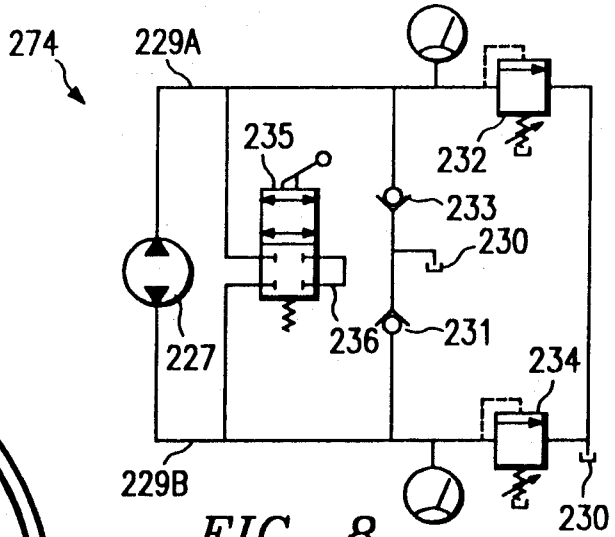
FIG. 8 is a schematic illustration of a hydraulic system for applying drag to the mounting ring of the tong shown in FIG. 7 to cause the jaws to engage the pipe with a predetermined radial pressure before rotation of the pipe begins.

Gear 226 is secured to the shaft of fluid motor 227. The purpose of motor 227 is to provide preset rotational resistance to drag ring 215 as shown in the schematic diagram of FIG. 8. The entire drag fluid assembly illustrated in FIG. 8 is designated by the numeral 274. The drag fluid assembly 274 can be used in conventional and other prior art open and closed face tongs, in addition to the embodiments disclosed herein, to control gripping and release of pipe.

In the schematic of FIG. 8, fluid motor 227 acts as a fluid pump to pressurize line 229A when driven in one direction by rotation of drag ring 215. This creates a suction on line 229B which draws fluid from reservoir 230 through check valve 231. When pressure on line 229A reaches a preset pressure determined by an adjustable pressure relief valve 232, motor 227 is allowed to turn. Rotational resistance on drag ring 215 is maintained by the preset pressure in line 229A.

When the fluid motor 227 is turned in the opposite direction, line 229B is pressurized. The resultant reduced pressure in line 229A draws fluid from reservoir 230 through check valve 233. When the pressure on line 229B reaches a preset pressure as determined by adjustable pressure relief value 234, valve 234 opens. Motor 227 is then allowed to rotate. Rotational resistance is maintained by preset pressure in line 229B, inducing rotational resistance on drag ring 215.

When the control valve 235 is activated, fluid is allowed to bypass motor 227 through line 236, thereby releasing rotational resistance when motor 227 is turned in either direction.

Referring again to FIG. 7, final drive gear 197 and drag ring 215 are shown with gripping assemblies 24 in retracted position. When the assemblies 24 are operated and forced inwardly against pipe 120, motor 199 is activated through conventional fluid power controls (not shown) to rotate final drive gear 197 in a clockwise direction. Since drag ring 215 is restrained to a preset torque by the drag fluid assembly 274 and drag motor 227 illustrated in FIG. 8, the drive gear 197 forces gripping assembly 24 rollers 212 and 213 along slopes 237B and 237A and then to cam surfaces 207 and 209. Roller 213A is forced along cam surface 205.

The three gripping assemblies 24 are designed to grip pipe 120 when it is concentric with final drive gear 197. During the time required for the torque applied to drive gear 197 to reach the preset torque drag on drag ring 215, the gripping jaws are forced against pipe 120 with the desired predetermined radial force. When the torque applied to drive gear 197 reaches the preset torque drag on drag ring 215, the appropriate check valve 232 or 234 opens, the drag is overcome and torque is applied to pipe 120 to rotate it. This preset torque resistance on drag ring 215 allows cam surfaces 205, 207 and 209 to apply predetermined radial gripping forces to pipe 120 before torque is applied to rotate pipe 120. This allows firm jaw engagement with pipe 120 and prevents skidding of jaw teeth on the pipe when the rotation force is applied. It also allows a large force angle (the angle measured between a radial line passing through the center of the pipe and the force vector applied to assemblies 24 by their respective cam surfaces 205, 207 and 209) on gripping assembly 24, thereby reducing radial stresses on drive gear 197. A force angle 248 is illustrated as an example in FIG. 11. The preferred force angle for all open face tong applications disclosed will result in a ratio of radial gripping force to the tangential rotational force within the range of 0.8 through 3.0, inclusive. A ratio of 1.10 is preferred because the radial force preferrably exceeds the tangential force by a factor of 0.10 to reasonably assure jaw teeth will not skid on the pipe 120.

FIG. 9 shows final drive gear 197, drag ring 215 and gripping assemblies 24 in the position when torque is being applied to pipe 120 in the clockwise direction to rotate pipe 120 (housing 195 and other gears are not shown). To release pipe 120, final drive gear 197 is rotated counterclockwise. Since drag ring 215 is prevented from turning by torque resistance from motor 227, rollers 212 and 213 on gripping assemblies 24 retract into relief notches 210 and 211 and roller 213A retracts along cam surface 205. The notches 210 and 211 can be used in conventional and other prior art open and closed face tongs and backups, in addition to the embodiments disclosed herein, to position the gripping means utilized in such devices.

The end 276 (see FIG. 7) of each of the two jaws 278 and 279 nearest the open throat 214, or a projection thereon such as shown in FIG. 3, contacts the intersection of passageway 275 and arcuate inner surface 277 of drag ring 215. This pivots jaws 278 and 279 so that the jaw ends 280 and 281 are moved out of the open throat 214 to permit pipe 120 to be inserted into or removed from the open throat of the tong. A spring 285 may, alternatively or additionally, be used to assist in positioning jaw ends 280 and 81 out of the open throat 214. At this point the open throat 214 in drive gear 197 and the throat in drag ring 215 are aligned with each other but not with gate 198. By activating valve 235 (bypassing motor 227) as shown in FIG. 8, drive gear 197 and drag ring 215 are held fixed relative to each other by rollers 212 and 213 which have been forced into notches 210 and 211 by springs 221. Thus, drive gear 197 and drag ring 215 are rotated in unison by motor 199 until throat 214 is aligned as shown in FIG. 7. Valve 235 is then released, shutting off motor 227 bypass.

Figure 11:
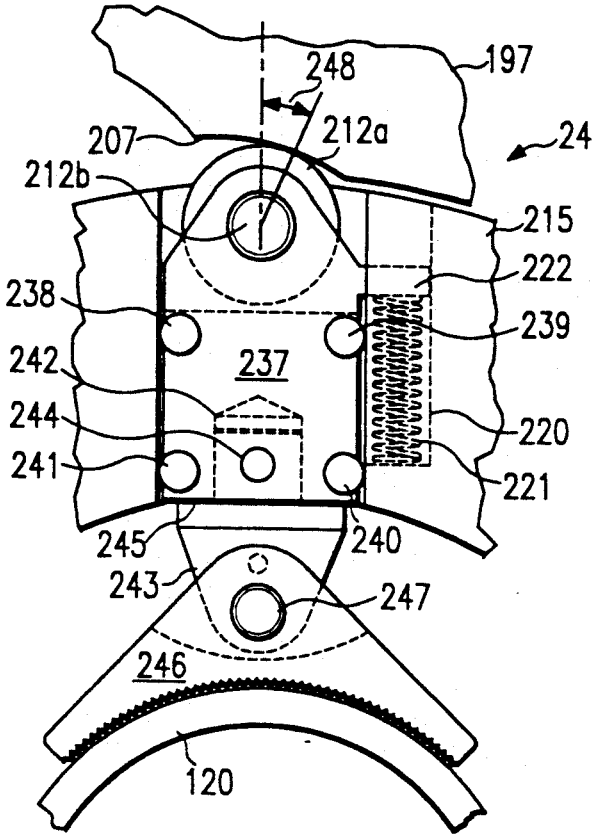
FIG. 11 is a partial side view of another alternate embodiment of the gripping assemblies used in the tong of FIG. 10.

FIG. 11 illustrates gripping assembly 24 in more detail as a side view. As previously described, final drive gear 197 forces gripping assembly 24 to drip pipe 120. Cam surface 207 engages roller 212*a* supported by shaft 212*b* in crosshead 237. Crosshead 237 travels radially within drag ring 215 on side rollers 238, 239, 240 and 241 which reduce the radial force necessary to grip pipe 120. Alternatively, the rollers 240 and 241 can be mounted only adjacent the lower side of the crosshead 237; only adjacent the upper side of the crosshead 237, or as otherwise desired. Crosshead 237 has an opening 242 into which is inserted jaw adapted 243 secured by screw 244. The radial load between crosshead 237 and jaw adapted 243 is borne by surface 245. Jaw 246 is hingedly connected to jaw adapted 243 by jaw pin 247. The purpose of jaw adapter 243 is to allow several pipe sizes to be gripped without changing crosshead 237. Gripping assembly 24 may also be used in back-up tongs. Force angle 248 on cam surface 207 is determined in a manner similar to that previously described for gripping assembly 20.

Figure 13:
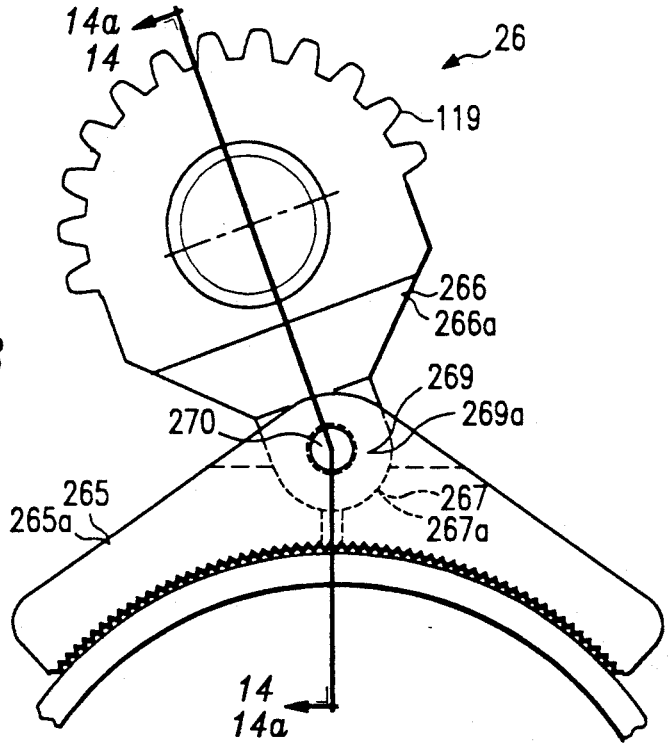
FIG. 13 is a side view of another alternate gripping assembly which can be used in the closed face power tong.
Figure 15:
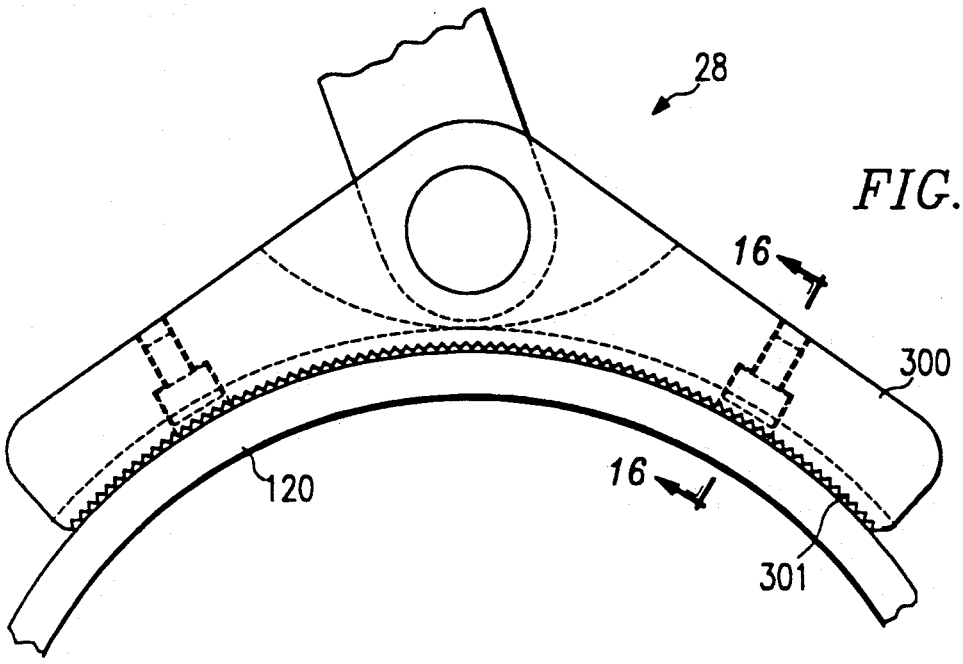
FIG. 15 is a partial side view of still another embodiment of a jaw assembly.
Figure 17:
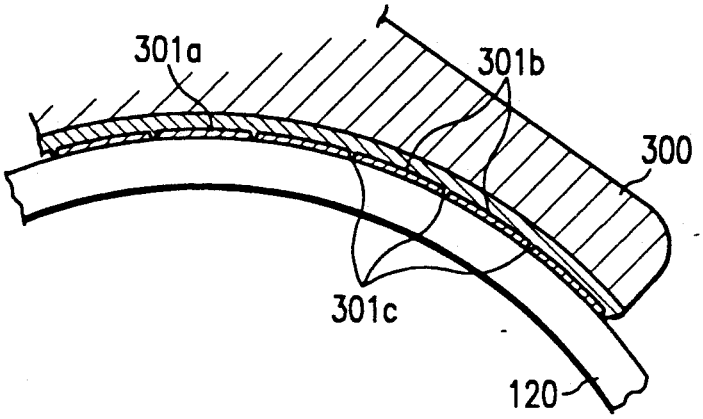
FIG. 17 is a partial side view of the assembly illustrated in FIG. 15 utilizing an alternate means of gripping pipe.

Jaw 246 may contain any of the features of jaw 143 of FIG. 3, jaw 178 of FIG. 5, jaw 265 of FIG. 13 or jaw 300 of FIGS. 15 and 17. Further, gripping assembly 24 may be used in a closed face tong if the drive ring (14 in FIG. 1 and FIG. 3) has cam surfaces for exerting force against the crosshead 237 and does not include a throat 214.

Figure 12:
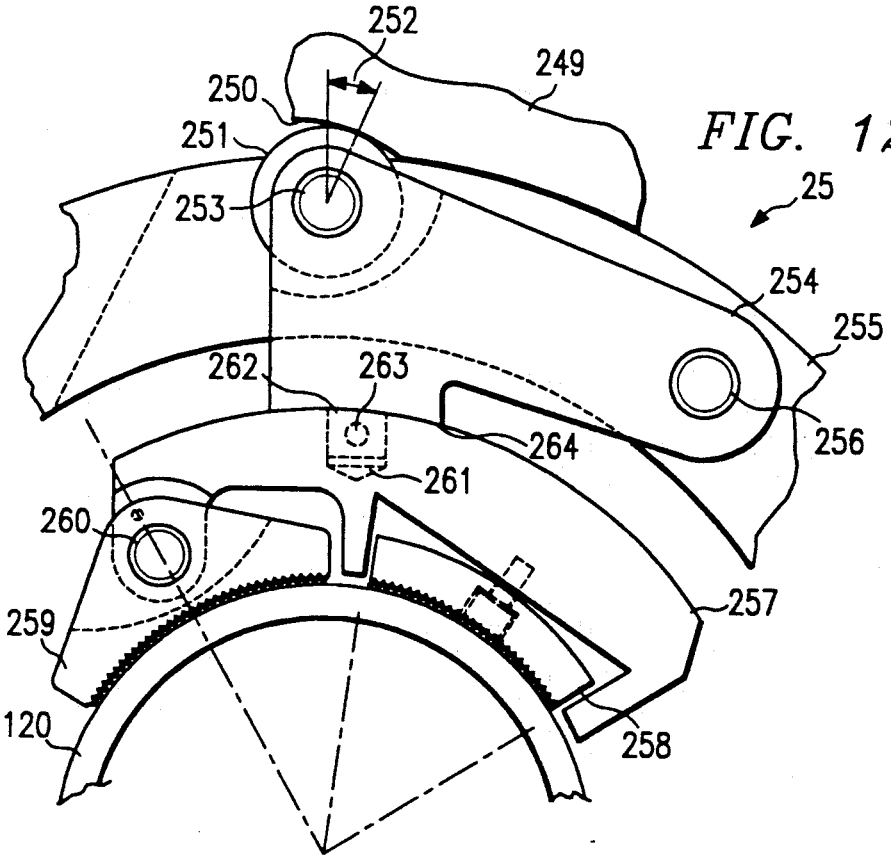
FIG. 12 is a partial side view of still another alternate gripping assembly which can be used in the tong of FIG. 10.

FIG. 12 illustrates another improvement in jaw construction for use in an open face ore closed face tongs. A final drive gear 249, similar to final drive gear 197 in FIG. 11, has a cam surface 250 which engages roller 251 at a predetermined force angle 252. The force angle 252 is computed in the same manner as done for gripping assembly 24 above. Shaft 253 supports roller 251 in link member 254 which is pivotally connected to drag ring 255 by shank 256. Link member 254 has a cylindrically or arcurately shaped sidewall portion 257 which contains a jaw segment 258 in a slot on one end as described above in references to FIGS. 5 and 6. It also contains a jaw 250 on the other end which is the same as previously described in reference to FIG. 3 and FIG. 4. Jaw 259 is hingedly connected to link member 254 by jaw pin 260. Sidewall portion 257 may have a plurality of inserts 258 and no jaw 259, if desired. Ripe gripping assembly 25 allows for misalignment with the pipe 120 resulting from wear of the jaw teeth and thus prevents pipe damage caused by resulting force concentrations at teeth contacting the pipe. Further, the gripping assembly 25 shown in FIG. 12 allows more of the pipe outside diameter to be covered with a single jaw.

Part 257 may be of different sizes to fit pipe 120 of different sizes. An opening 261 in part 257 enables a post 262 on link member 254 to be inserted therein and secured by screw 263. Surface 264 bears the radial load which results from gripping pipe 120.

A mechanical advantage can be obtained by moving post 262 and opening 261 to the right in FIG. 12, thereby allowing the radial force on pipe 120 to be divided between roller 251 and shaft 256. This reduces outward radial forces on roller 251 and final drive gear 249.

Figure 14:
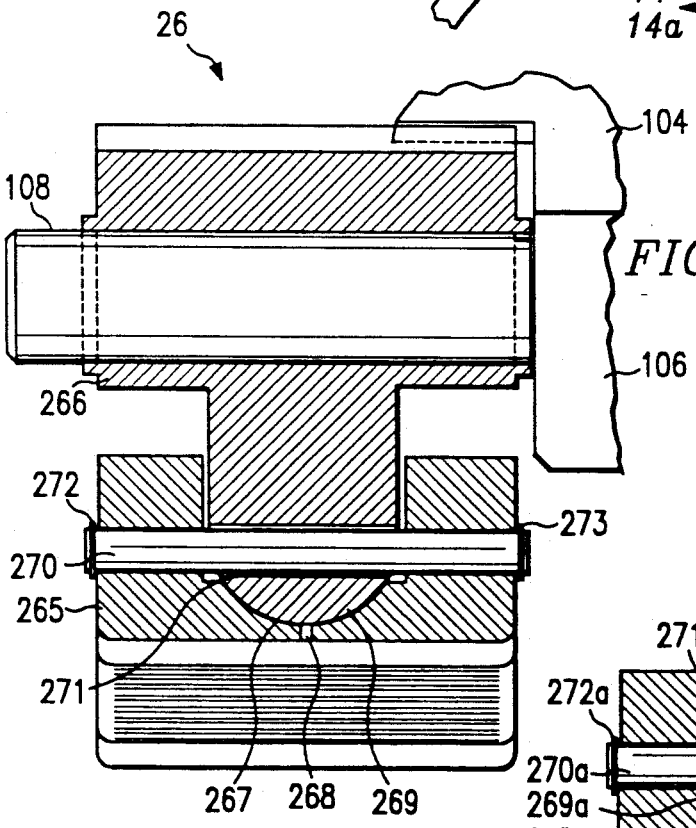
FIG. 14 is a cross-sectional view of the alternate gripping assembly of FIG. 13 taken along section lines 14—14 of FIG. 13 and illustrating a first design for pivotally supporting an associated jaw.

FIG. 13 is a side view of an alternate embodiment of a gripping assembly 26 and FIG. 14 is a cross-sectional view thereof. Gripping assembly 26 differs from the other gripping assemblies in that jaw 265 is pivoted to jaw link 266 by a spherical socket 267. An opening 268 provides tool relief to allow cutting of socket or spherical surface 267. The socket 267 receives the ball-shaped end 269 of jaw link 266. Jaw 265 is loosely secured to jaw link 266 by pin 270 through a loose fitting hole 271 and is secured by snap rings 272 and 273. The loosely fitted pin 270 and opening 271 allow for axial misalignment of pipe 120 to final drive gear 104 and drag ring 106. However, a balanced gripping force is still applied from jaw 265 to pipe 120 even while torque forces are turning pipe 120. Rotational and gripping forces are applied to the socket 267 by the ball 269, thereby avoiding or minimizing shear stress which would otherwise be imposed on the pin 270. The spherical jaw pivot of gripping assembly 26 may be used on any of the gripping assemblies 20 of FIG. 3, 21 of FIG. 5, 24 of FIG. 11, and 28 of FIG. 15.

Figure 14A:
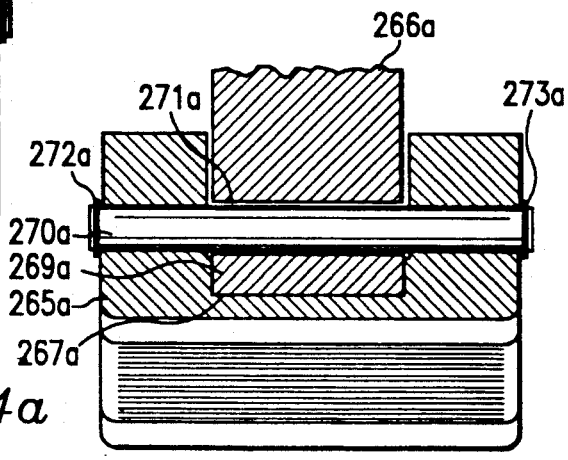
FIG. 14*a* is a cross-sectional view of the alternate gripping assembly of FIG. 13 taken along section lines 14*a*–14*a* of FIG. 13 and illustrating a second design for pivotally supporting an associated jaw.

FIG. 14*a* is a cross-sectional view of the gripping assembly 26 shown in FIG. 13 embodying an alternate design for pivotally supporting a gripping jaw 265*a*. Jaw 265*a* is pivotally supported by a jaw link 266*a*. Jaw link 266*a* has a convex end 269*a* which is received by and bears against a matching concave surface 267*a* formed in the jaw 265*a*. Jaw 265*a* is loosely secured to jaw link 266*a* by a pin 270*a*, through a loose fitting hole 271*a*, and is secured by snap rings 272*a* and 273*a*. The loosely fitted pin 270*a* and opening 271*a* allow the force supplied to the jaw 265*a* by the jaw link 266*a* to be borne substantially entirely by the concave surface 267*a*, thereby avoiding or minimizing shear stress which would otherwise be imposed on the pin 270*a*. The jaw pivot design of gripping assembly 26 shown in FIG. 14*a* may be used on any of the gripping assemblies 20 of FIG. 3, 21 of FIG. 5, 24 of FIG. 11, and 28 in FIG. 15.

Figure 16:
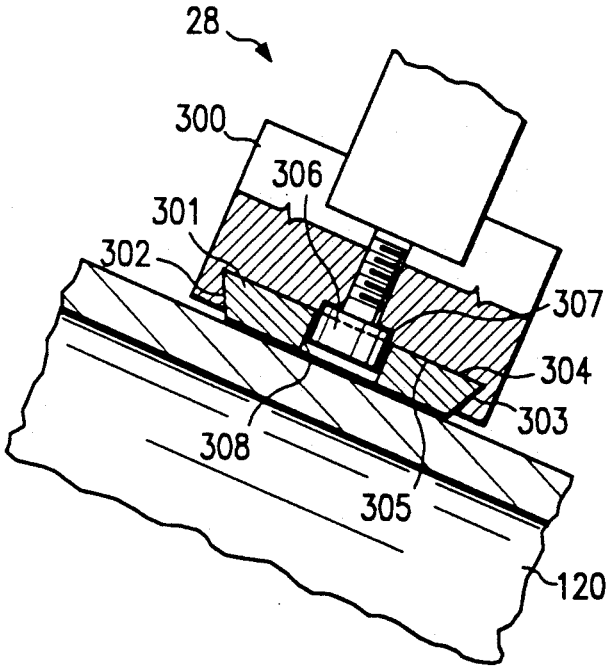
FIG. 16 is a cross-sectional view of the embodiment of FIG. 15 taken along section lines 16—16.

FIGS. 15 and 16 disclose a jaw 300 having a jaw insert 301. The insert 301 is held within a groove 305 in jaw 300 having dovetail sidewalls 302 and 303. Other suitable groove designs (not shown) may also be used as fastening means to secure the insert 301. The outside diameter 304 of insert 301 matches groove 305 and has a curved friction surface 309 concentric with pipe 120.

Insert 301 slides within dovetail groove 305 and sidewalls 302 and 303 with enough clearance to allow easy removal. When insert 301 is in place, cap screw 306 screws into jaw 300. A counterface 307 closely fits the head of cap screw 306 so shear loads, created as insert 301 is forced against cap screw 306 by torque applied to pipe 120, will be absorbed by the head of cap screw 306 instead of its threaded portion. An opening 308 in insert 301 allows a close fit to the head of cap screw 306.

FIG. 17 illustrates the jaw 300 utilizing an alternate gripping segment comprising an arcuate backing segment 301*a* to which is secured a number of gripping pads 301*b*. The segment 301*a* is preferrably secured to the jaw 300 in the same manner insert 301 (FIGS. 15 and 16). The gripping pads 301*b* as is insert 301 (FIGS. 15 and 16). The gripping pads 301*b* are arranged to fit substantially flush with the exterior surface of the pipe 120. The gripping pads 301*b* are semi-resilient, high-friction material, such as automobile brake shoe material. Extending from the backing segment 301*a* between the gripping pads 301*b* are a number of lugs 301*c*. The lugs 301*c* assist in holding the gripping pads 301*b* against transverse movement which might otherwise result from shear forces imparted to the gripping pads 301*b* when torque is applied to the pipe 120 by the jaw 300.

The foregoing novel power tongs have improved gripping means and fluid drag assemblies which provide controlled drag on the drag rings, thereby allowing use of larger force angles, reduced radial loads on the gripping assemblies and reduced jaw loads on the pipe. This is accomplished primarily by a greater initial preload of the jaw on the pipe before the pipe is torqued which reduces teeth skidding marks on the pipe. The drag is adjustable to any predetermined amount. Projection lugs and/or springs on the jaws are used to center the jaws as they retract, thus keeping the jaws out of the way of pipe inserted either radially or axially into the gripping apparatus.

The novel positioning means comprising friction means and/or springs control jaw position during extension to and retraction from the pipe. The gripping assemblies can be inserted into existing power tongs without modification. Even in prior art tongs which use a five pin drag ring, the gripping assemblies 20, 21, 26 and 28 disclosed herein can be pivotally attached to three of the five existing pins. The assemblies leave no significant marks on the cylindrical pipe gripped and do not appreciably deform the gripped pipe appreciably.

Use of the present gripping assemblies allows substantially the entire pipe circumference to be encircled by the jaws. Moreover, by using three gripping assemblies in open throat tongs operating directly off the drive gear, the radial load is divided into three parts whereas in the prior art the open throat tongs must divide the radial load into only two parts.

With the novel jaw assemblies and drag assemblies disclosed herein, the initial gripping force on the pipe is predetermined and the gripping force during operation is proportional to the applied torque. The gripping teeth or surfaces have a predetermined area (calculated from the expected maximum gripping force) sufficient to prevent the pipe from being overstressed by the predetermined radial force and to prevent the yield strength of the pipe from being exceeded. The invention also allows use of removable jaw link adapters and replaceable jaw teeth so that various pipe sizes can be accommodated without replacing an entire gripping assembly for each pipe size. With the replaceable jaw segments disclosed, a much better fit of the jaw to the pipe can be obtained and the jaws may be used with many existing tongs.

The jaws disclosed herein can torque the pipe in both directions without removal from the power tongs or back-up. They may be internally smooth or use teeth or other friction surfaces. Similarly, one jaw may have teeth and the others smooth. Any combination thereof may be used. By using the gripping assembly with a spherical jaw pivot, the pipe can be gripped evenly even when it is axially misaligned with the final drive gear and drag ring. The spherical jaw pivot may be used with any of the gripping assemblies disclosed herein. Such assemblies, of course, may be used in power tongs and back-ups.

Only the preferred embodiments of the invention have been described. It should be understood that the invention is not limited to the embodiments disclosed. The invention embraces and includes any alternatives, modifications, rearrangements and substitutions of parts or elements as fall within the spirit and scope of this disclosure.

What is claimed:

1. Apparatus for gripping the surface and applying torque about the longitudinal axis of a tubular element comprising:

(a) a plurality of gripping assemblies, each including (i) a jaw having a gripping surface pivotally mounted on the gripping assembly and adapted for movement between a retracted position which permits insertion and removal of a tubular element into and from the apparatus and an extended position which permits engagement of the jaw with a tubular element within the apparatus; and (ii) a jaw link pivotally supporting each jaw;

(b) means for activating the gripping assemblies to extend and retract the jaws into and out of contact with the tubular element, to apply torque though the jaws about the longitudinal axis of the tubular element when the jaws contact the tubular element, and to apply gripping force to the tubular element which varies substantially in proportion to the torque applied to the tubular element, thereby minimizing or avoiding slippage of the jaws against the tubular element;

(c) jaw engagement control means responsive to initial activation of the gripping assemblies for applying a predetermined gripping force to the tubular element through the jaws prior to application of torque to the tubular element, thereby minimizing or avoiding slippage of the jaws over the surface of the tubular element as the torque applied to the tubular element initially increases; and (d) positioning means to control free pivotal movement of the jaw with respect to the jaw link which includes (i) an opening extending through said jaw;

(ii) a friction member in said opening in contact with said jaw link;

(iii) resilient means in said opening in contact with said friction member; and (iv) means for compressing said resilient means against said friction member to adjust the frictional contact between said friction member and said jaw link.

2. Apparatus as defined in claim wherein said resilient means is an elastomer plug.

3. Apparatus as defined in claim 1 wherein said resilient means is a spring.

4. Apparatus as defined in claim 1 wherein said compressing means is a set screw.

5. Apparatus for gripping the surface and applying torque about the longitudinal axis of a tubular element comprising:

(a) a plurality of gripping assemblies, each including a jaw having a gripping surface pivotally mounted on the gripping assembly and adapted for movement between a retracted position which permits insertion and removal of a tubular element into and from the apparatus and an extended position which permits engagement of the jaw with a tubular element within the apparatus;

(b) means for activating the gripping assemblies to extend and retract the jaws into and out of contact with the tubular element, to apply torque through the jaws about the longitudinal axis of the tubular element when the jaws contact the tubular element, and to apply gripping force to the tubular element which varies substantially in proportion to the torque applied to the tubular element, thereby minimizing or avoiding slippage of the jaws against the tubular element; and (c) jaw engagement control means responsive to initial activation of the gripping assemblies for applying a predetermined gripping force to the tubular element through the jaws prior to application of torque to the tubular element, thereby minimizing or avoiding slippage of the jaws over the surface of the tubular member as the torque applied to the tubular element initially increases, including (i) a rotatable drag ring supporting the gripping assemblies for pivotal movement between extended and retracted positions;

(ii) a rotatable drive gear for actuating the gripping assemblies to engage, disengage and apply torque to said tubular element, said drive gear rotatable relative to said drag ring to pivot said gripping assemblies and jaws between said extended and retracted positions;

(iii) motor means for selectively rotating the drive gear;

(iv) drag ring control means coupled to said drag ring for applying an adjustable drag force thereto which prevents said drag ring from rotating until said jaws are urged against said tubular element with a predetermined radial gripping force prior to rotation of said gripping assemblies, said drag ring control means including (1) brake means responsive to the application of pressurized fluid for applying a braking force to resist rotation of said drag ring and securing said drag ring against rotation until a predetermined gripping force is applied to the tubular element by the jaws and thereafter releasing said drag ring for rotation;

(2) a supply of pressurized fluid for actuating said brake means and said drive gear motor means; and (3) brake control means including an adjustable relief valve operable to relieve the pressure of fluid applied to said brake means once the pressure supplied to the motor means exceeds a predetermined pressure corresponding to a predetermined radial gripping force applied by said gripping assemblies to said tubular element, thereby releasing the drag ring for rotation once said predetermined gripping force is applied; and (v) a fluid direction reversing valve for applying said pressurized fluid to said brake means through said adjustable relief valve when in a first position to apply a braking force to said drag ring, and for applying said pressurized fluid to said brake means in an opposite direction when in a second position to release the drag force applied to said drag ring by said brake means.

6. Apparatus as defined in claim 5 further comprising:

a sequencing valve for receiving the fluid driving said motor means in either direction, said sequencing valve being set to produce an output only when rotation of said drive gear urges said gripping assemblies against said tubular element with said predetermined gripping force; and means coupling said output of said sequencing valve to said reversing valve so as to deactivate said brake means and cause said drag force to be removed from said drag ring.

7. Apparatus for gripping the surface and applying torque about the longitudinal axis of a tubular element comprising:

(a) a plurality of gripping assemblies, each including a jaw having a gripping surface pivotally mounted on the gripping assembly and adapted for movement between a retracted position which permits insertion and removal of a tubular element into and from the apparatus and an extended position which permits engagement of the jaw with a tubular element within the apparatus;

(b) means for actuating the gripping assemblies to extend and retract the jaws into and out of contact with the tubular element, to apply torque through the jaws about the longitudinal axis of the tubular element when the jaws contact the tubular element, and to apply a gripping force to the tubular element which varies substantially in proportion to the torque applied to the tubular element, thereby minimizing or avoiding slippage of the jaws against the tubular element; and (c) jaw engagement control means responsive to initial activation of the gripping assemblies for applying a predetermined gripping force to the tubular element through the jaws prior to application of torque to the tubular element, thereby minimizing or avoiding slippage of the jaws over the surface of the tubular element as the torque applied to the tubular element initially increases, including (i) a rotatable drag ring supporting the gripping assemblies for movement between extended and retracted positions;

(ii) a rotatable drive gear for actuating the gripping assemblies to engage, disengage and apply torque to said tubular element, said drive gear rotatable relative to said drag ring to move said gripping assemblies and jaws between said extended and retracted positions;

(iii) motor means for selectively rotating the drive gear;

(iv) drag ring control means coupled to said drag ring for applying an adjustable drag force thereto which prevents said drag ring from rotating until said jaws are urged against said tubular element with a predetermined radial gripping force prior to rotation of said gripping assemblies;

(v) braking motor means coupled to said drag ring and adapted to be driven as a pump and create fluid pressure when said drag ring rotates; and (vi) braking motor control means for controlling the drag force applied to said drag ring by said braking motor means, said braking motor control means including:

(1) a fluid reservoir;

(2) fluid lines coupling said fluid reservoir to said braking motor means; and (3) valve means in said fluid lines for preventing said braking motor means and the coupled drag ring from rotating by preventing fluid flow until a predetermined pressure exists in said fluid lines, said valve means including (a) first relief valve means in said fluid lines preventing fluid flow from said braking motor means in one direction until a predetermined pressure is attained; and (b) second relief valve means in said fluid lines preventing fluid flow from said braking motor means in the other direction until a predetermined pressure is attained, thereby preventing rotation of said motor means in either direction until a predetermined pressure is attained.

8. Apparatus as defined in claim 7 wherein said first and second relief valves are pressure adjustable to vary said predetermined pressure and the resulting predetermined gripping force.

9. A gripping assembly in apparatus for gripping the surface of a tubular element including a drive gear adapted to axially receive the tubular element and rotatable to urge the gripping assembly into gripping contact with the tubular element surface and a mounting ring coupled to the gripping assembly and drive gear for translating rotational movement of the drive gear into radial movement of the gripping assembly into and out of a gripping relationship with the surface of the tubular element, said gripping assembly comprising:

(a) a jaw link pivotally coupled to a mounting ring;

(b) a jaw pivotally coupled to said jaw link and having an arcuately-shaped gripping surface for gripping a tubular element; and (c) positioning means for controlling free pivotal movement of said jaw with respect to said jaw link including (i) an opening extending through said jaw;

(ii) friction means in said opening in contact with said jaw link for resisting pivotal movement of said jaw;

(iii) resilient means in said opening in contact with said friction means; and (iv) means for urging said resilient means against said friction means to adjust the resistance to pivotal movement imparted to said jaw.

10. Apparatus as defined in claim 9 wherein said resilient means is an elastomer plug.

11. Apparatus as defined in claim 9 wherein said urging means is a set screw.

12. Apparatus for gripping the surface of a tubular element comprising:

(a) a plurality of gripping means for gripping a tubular element;

(b) means for activating the gripping means to extend and retract the gripping means into and out of contact with the tubular element, to apply torque about the longitudinal axis of the tubular element when the gripping means contacts the tubular element and to apply a gripping force to the tubular element through the gripping means; and (c) gripping means control means responsive to initial activation of the gripping means adapted to apply a predetermined gripping force to the tubular element through the gripping means prior to application of torque to the tubular element, thereby minimizing or avoiding slippage of the gripping means over the surface of the tubular element as the torque applied to the tubular element initially increases, wherein the activating means and gripping means control means include:

(i) a rotatable drag ring supporting the gripping means for movement between extended and retracted positions;

(ii) a rotatable drive gear for actuating the gripping means to engage, disengage and apply torque to said tubular element, said drive gear rotating relative to said drag ring to move said gripping means between said extended and retracted positions;

(iii) motor means for selectively rotating the drive gear;

(iv) brake means responsive to the application of pressurized fluid for selectively applying a braking force to resist rotation of said drag ring, said brake means securing said drag ring against rotation until a predetermined gripping force is applied to said tubular element by said gripping means and thereafter releasing said drag ring for rotation;

(v) a supply of pressurized fluid for actuating said brake means and the drive gear motor means;

(vi) brake control means including adjustable relief valve means operable to relieve the pressure of fluid applied to the brake means once the pressure applied to the motor means exceeds a predetermined pressure corresponding to a predetermined radial gripping force applied by said gripping means to said tubular element, thereby releasing the drag ring for rotation once said predetermined gripping force is applied; and (vii) fluid direction reversing valve means operable to apply said pressurized fluid to said brake means through said adjustable relief valve means when in a first position to apply a braking force to said drag ring, and to apply said pressurized fluid to said brake means in an opposite direction when in an second position to release the drag force applied to said drag ring by said brake means.

13. Apparatus as defined in claim 12 further comprising:

a sequencing valve adapted to receive the fluid pressure driving said motor means in either direction and set to produce an output only when rotation of said drive gear urges said gripping assemblies against said tubular element with said predetermined gripping force; and means coupling the output of said sequencing valve to said reversing valve to deactivate said brake means and cause said drag force to be removed from said drag ring.

14. Apparatus for gripping the surface of a tubular element comprising:

(a) a plurality of gripping means for gripping a tubular element;

(b) means for activating the gripping means to extend and retract the gripping means into and out of contact with the tubular element, to apply torque about the longitudinal axis of the tubular element when the gripping means contacts the tubular element, and to apply a gripping force to the tubular element through the gripping means; and (c) gripping means control means responsive to initial activation of the gripping means adapted to apply a predetermined gripping force to the tubular element through the gripping means prior to application of torque to the tubular element, thereby minimizing or avoiding slippage of the gripping means over the surface of the tubular element as the torque applied to the tubular element initially increases, wherein the activating means and gripping control means include (i) a rotatable drag ring supporting the gripping means for movement between extended and retracted positions;

(ii) a rotatable drive gear for actuating the gripping means to engage, disengage and apply torque to said tubular element, said drive gear rotating relative to said drag ring to move said gripping means between said extended and retracted positions;

(iii) motor means for selectively rotating the drive gear;

(iv) drag ring control means coupled to said drag ring for applying an adjustable drag force thereto and preventing said drag ring from rotating until said gripping means is urged against said tubular element with a predetermined radial gripping force prior to rotation of said gripping means;

(v) braking motor means coupled to said drag ring and adapted to be driven as a pump and create fluid pressure when said drag ring rotates; and (vi) braking motor control means for controlling the drag force applied to the said drag ring by said braking motor means including (1) a fluid reservoir;

(2) fluid lines coupling said fluid reservoir to said braking motor means; and (3) valve means in said fluid lines for preventing said braking motor means and the coupled drag ring from rotating by preventing fluid flow until a predetermined pressure exists in said fluid lines.

15. Apparatus as defined in claim 14 wherein said valve means comprises:

a first relief valve in said fluid lines for preventing fluid flow from said braking motor means in one direction until a predetermined pressure is attained; and a second relief valve in said fluid lines for preventing fluid flow from said braking motor means in the opposite direction until a predetermined pressure is obtained and prevent rotation of said motor means in either direction until said predetermined pressure is obtained.

16. Apparatus as defined in claim 15 wherein said first and second relief valves are pressure adjustable to vary said predetermined pressure and the resulting predetermined gripping force.

17. Apparatus for gripping the surface of a tubular element comprising:

(a) a plurality of gripping means for gripping a tubular element;

(b) means for activating the gripping means to extend and retract the gripping means into and out of contact with the tubular element, to apply torque about the longitudinal axis of the tubular element when the gripping means contacts the tubular element and to apply a gripping force to the tubular element through the gripping means; and (c) gripping means control means responsive to initial activation of the gripping means adapted to apply a predetermined gripping force to the tubular element through the gripping means prior to application of torque to the tubular element, thereby minimizing or avoiding slippage of the gripping means over the surface of the tubular element as the torque applied to the tubular element initially increases, wherein the activating means and gripping means control means include:

(i) a rotatable drag ring supporting the gripping means for movement between extended and retracted positions;

(ii) a rotatable drive gear for actuating the gripping means to engage, disengage and apply torque to said tubular element, said drive gear rotating relative to said drag ring to move said gripping means between said extended and retracted positions;

(iii) motor means for selectively rotating the drive gear;

(iv) brake means responsive to the application of pressurized fluid for selectively applying a braking force to resist rotation of said drag ring, said brake means securing said drag ring against rotation until a predetermined gripping force is applied to said tubular element by said gripping means and thereafter releasing said drag ring for rotation; and (v) a supply of pressurized fluid for actuating said brake means and the drive gear motor means.

18. The method of controlling the radial gripping force applied to the surface of a tubular element in apparatus for gripping the surface and applying rotational torque about the longitudinal axis of such tubular element which includes a housing; a plurality of gripping assemblies, each including a jaw having a gripping surface and adapted for movement between a retracted position and an extended position in contact with the surface of a tubular element; a rotatable draw ring supporting the gripping assemblies; and a drive gear carried by said housing rotatable with respect to said housing and said drag ring and adapted to actuate said gripping assemblies to engage the surface of the tubular element and apply torque thereto when rotated in a first direction and to disengage the gripping assemblies from the tubular element when rotated in the opposite direction comprising the steps of:

(a) applying fluid pressure to a fluid cylinder which activates a brake for controlling rotation of said drag ring, thereby holding the drag ring in a rotational position which is fixed with respect to the tubular element and the housing;

(b) rotating the drive gear to cause the gripping assemblies to engage the surface of the tubular element;

(c) permitting the drag ring to rotate with respect to said housing, thereby applying rotational torque to the tubular element, only after a predetermined radial force has been applied to the tubular element by the jaws; and (d) maintaining at least said predetermined radial force on the tubular element so long as any rotational torque is applied to the tubular element.

19. The method set forth in claim 18 including the step of maintaining the radial force on the tubular element substantially in proportion to the rotational torque applied to the tubular element.

20. The method set forth in claim 18 including the step of rotating the drive gear with a fluid motor and using the fluid pressure which drives said fluid motor to control rotation of the drag ring.

21. Apparatus for gripping the surface and applying rotational torque about the longitudinal axis of a tubular element comprising:

(a) a housing:

(b) a plurality of gripping assemblies, each including a jaw having a gripping surface adapted for movement between a retracted position and an extended position in contact with the surface of a tubular element;

(c) a rotatable drag ring supporting the gripping assemblies;

(d) a drive gear carried by said housing rotatable with respect to said housing and said drag ring and adapted to actuate said gripping assemblies to engage the surface of the tubular element and apply torque thereto when rotated in a first direction and to disengage the gripping assemblies from the tubular element when rotated in the opposite direction;

(e) brake means which, when activated, substantially prevents rotation of said drag ring until a predetermined gripping force is applied to the surface of the tubular element by the gripping assemblies;

(f) a fluid cylinder which activates said brake means;

(g) a source of pressurized fluid connected to said cylinder; and (h) a valve operable to relieve the fluid pressure in said cylinder when the pressure on said valve reaches a predetermined value.

22. Apparatus as defined in claim 21 including a fluid motor adapted to rotate said drive gear and wherein said source of pressurized fluid is connected to said fluid motor and said fluid cylinder.

23. Apparatus as defined in claim 21 wherein at least one jaw includes a replaceable arcuate gripping member forming said gripping surface.

24. Apparatus as defined in claim 23 wherein the radius of curvature of the arcuate gripping member is substantially equivalent to the outer diameter of the tubular member and the lateral ends and sides of the gripping member have substantially rounded edges.

25. Apparatus as defined in claim 21 wherein said jaw is pivotally mounted on a jaw support.

26. Apparatus as defined in claim 25 including positioning means to control relative pivotal movement between said jaw and said jaw support.

27. Apparatus for gripping the surface and applying rotational torque about the longitudinal axis of a tubular element comprising:

(a) a housing;

(b) a rotatable drag ring;

(c) a drive gear carried by said housing and rotatable with respect to said housing and said drag ring and having a plurality of camming surfaces thereon; and (d) a plurality of gripping assemblies support by said drag ring and adapted for movement between a retracted position and an extended position in contact with the surface of a tubular element, each said gripping assembly including (i) a jaw support having an inner end and an outer end mounted on said drag ring;

(ii) a plurality of rotatable bearings between said gripping assembly and said drag ring which permit said jaw support to move between a retracted position and an extended position;

(iii) camming means mounted on said outer end adapted to mate with a camming surface on said drive gear; and (iv) a jaw having a gripping surface mounted on the inner end of said jaw support.

28. Apparatus as defined in claim 27 wherein said jaw is pivotally mounted on said jaw support.

29. Apparatus as defined in claim 28 including positioning means to control relative pivotal movement between said jaw and said jaw support.

30. Apparatus as defined in claim 29 wherein said positioning means comprises spring means between said jaw and said jaw support.

31. Apparatus as defined in claim 29 wherein said positioning means comprises:

(a) a friction member carried by one of said jaw and said jaw support and adapted to engage the other of said jaw and said jaw support;

(b) resilient means for urging said friction member into contact with said other of said jaw and said jaw support; and (c) means for adjusting the force exerted by said resilient means to control relative pivotal movement between said jaw and said jaw support.

32. Apparatus as defined in claim 27 wherein said jaw is carried on a jaw adapter which is removeable from said jaw support.

33. Apparatus as defined in claim 27 wherein said jaw includes a replaceable arcuate gripping member forming said gripping surface.

34. Apparatus as defined in claim 33 wherein the radius of curvature of the arcuate gripping member is substantially equivalent to the outer diameter of the tubular member and the lateral ends and sides of the gripping member have substantially rounded edges.

35. Apparatus for gripping the surface and applying rotational torque about the longitudinal axis of a tubular element comprising:

(a) a housing;

(b) a rotatable drag ring;

(c) a drive gear carried by said housing and rotatable with respect to said housing and said drag ring and having a plurality of camming surfaces thereon; and (d) a plurality of gripping assemblies supported by said drag ring and adapted for movement between a retracted position and an extended position in contact with the surface of a tubular element, each said gripping assembly including (i) a jaw support having an inner end and an outer end mounted on said drag ring and adapted for reciprocal movement which permits said jaw support to move between a retracted position and an extended position;

(ii) camming means mounted on said outer end adapted to mate with a camming surface on said drive gear; and (iii) resilient means between said jaw support and said drag ring adapted to urge said jaw support toward said retracted position; and (iv) a jaw having a gripping surface mounted on the inner end of said jaw support.

36. Apparatus as defined in claim 35 wherein said jaw is pivotally mounted on said jaw support.

37. Apparatus as defined in claim 36 including positioning means to control relative pivotal movement between said jaw and said jaw support.

38. Apparatus as defined in claim 37 wherein said positioning means comprises spring means between said jaw and said jaw support.

39. Apparatus as defined in claim 37 wherein said positioning means comprises:

(a) a friction member carried by one of said jaw and said jaw support and adapted to engage the other of said jaw and said jaw support;

(b) resilient means for urging said friction member into contact with said other of said jaw and said jaw support; and (c) means for adjusting the force exerted by said resilient means to control relative pivotal movement between said jaw and said jaw support.

40. Apparatus as defined in claim 35 wherein said jaw is carried on a jaw adapter which is removeable from said jaw support.

41. Apparatus as defined in claim 35 wherein said jaw includes a replaceable arcuate gripping member forming said gripping surface.

42. Apparatus as defined in claim 41 wherein the radius of curvature of the arcuate gripping member is substantially equivalent to the outer diameter of the tubular member and the lateral ends and sides of the gripping member have substantially rounded edges.

43. A jaw assembly comprising:

(a) a jaw link having a first end and a second end and adapted to be mounted on and pivotable about a support pin passing transversely therethrough;

(b) a jaw having a generally concave gripping surface; and (c) a pivotable connection supporting said jaw on the second end of said jaw link including mating curved bearing surfaces on the second end of said jaw link and the jaw supported thereby and a pin passing through both said second end of said jaw link and said jaw maintaining said jaw link and said jaw in a loosely connected relationship whereby force exerted on said gripping surface is transmitted to said jaw link through said mating curved bearing surfaces.

44. A jaw assembly as defined in claim 43 wherein said mating curved surfaces are curved only along an axial arc substantially concentric with the axis of said pin.

45. A jaw assembly as defined in claim 43 wherein said mating curved surfaces are curved along a radial arc substantially concentric with the axis of said pin and also curved to define an arc which intersects the axis of said pin.

46. A jaw assembly as defined in claim 43 wherein said mating curved surfaces form substantially hemispherical mating surfaces.

47. Apparatus for gripping the surface and applying rotational torque about the longitudinal axis of a tubular element comprising:

(a) a housing;

(b) a plurality of gripping assemblies, each including a jaw having a gripping surface and adapted for movement between a retracted position and an extended position in contact with the surface of a tubular element;

(c) a rotatable drag ring supporting the gripping assemblies;

(d) a drive gear carried by said housing rotatable with respect to said housing and said drag ring and having a camming surface adapted to actuate said gripping assemblies to engage the surface of the tubular element and apply torque thereto when rotated in a first direction and to disengage the gripping assemblies from the tubular element when rotated in the opposite direction; and (e) a jaw link supporting each said jaw on said drag ring, said jaw link comprising:

(i) an elongated body having a first end and a second end;

(ii) pin means pivotally securing said first end to said drag ring so that said second end may move radially about said pin means between said retracted position and said extended position;

(iii) means securing said jaw to said jaw link with said concave gripping surface oriented to move toward the longitudinal axis of the tubular member when said jaw link is moved toward said extended position; and (iv) roller means adapted to engage said camming surface.

48. In apparatus for gripping the surface and applying rotational torque about the longitudinal axis of a tubular element in which a plurality of gripping assemblies are moved between an extended position in contact with the tubular element and a retracted position, a jaw assembly comprising:

(a) a jaw body having a generally concave surface adapted to extend substantially concentric with a portion of the surface of a tubular element;

(b) at least one recess defining a floor in said concave surface of said jaw body;

(c) an insert positioned within said recess, said insert having a first major face which is generally concave and extends beyond the generally concave surface of the jaw body and a second major face opposite said first major face which engages said floor, the surface of said floor and the surface of said second major face engaging in a relationship in which one such surface is substantially flat and the other such surface is convexly curved with respect thereto; and (d) means loosely maintaining said insert within said recess and permitting the concave major face of said insert to automatically adjust to uniformly engage the surface of the tubular member when the gripping assembly is extended by adjusting the engagement between the floor of the recess and the second major face of the insert.

49. Apparatus for gripping the surface and applying rotational torque about the longitudinal axis of a tubular element comprising:

(a) a housing;

(b) a plurality of gripping assemblies, each including a jaw having a gripping surface pivotally mounted on a jaw support and adapted for movement between a retracted position and an extended position in contact with the surface of a tubular element;

(c) a rotatable drag ring supporting the gripping assemblies;

(d) a drive gear carried by said housing rotatable with respect to said housing and said drag ring and adapted to actuate said gripping assemblies to engage the surface of the tubular element and apply torque thereto when rotated in a first direction and to disengage the gripping assemblies from the tubular element when rotated in the opposite direction;

(e) positioning means to control relative pivotal movement between said jaw and said jaw support comprising:

(i) a friction member carried by one of said jaw and said jaw support and adapted to engage the other of said jaw and said jaw support;

(ii) resilient means for urging said friction member into contact with said other of said jaw and said jaw support; and (iii) means for adjusting the force exerted by said resilient means to control relative pivotal movement between said jaw and said jaw support.

50. Apparatus as defined in claim 49 wherein said jaw is carried on a jaw adapter which is removeable from said jaw support.

51. Apparatus as defined in claim 49 wherein said jaw includes a replaceable arcuate gripping member forming said gripping surface.

52. Apparatus as defined in claim 51 wherein the radius of curvature of the arcuate gripping member is substantially equivalent to the outer diameter of the tubular member and the lateral ends and sides of the gripping member have substantially rounded edges.

53. Apparatus for gripping the surface and applying torque about the longitudinal axis of a tubular element comprising:

(a) a plurality of gripping assemblies, each including a jaw defining a spherical socket and a gripping surface mounted on the gripping assembly and adapted for movement between a retracted position which permits insertion and removal of a tubular element into and from the apparatus and an extended position which permits engagement of the jaw with the tubular element within the apparatus wherein the gripping surface of the jaw has a surface area for contacting the tubular element which is sufficiently great to grip the tubular element without exceeding the yield strength of the surface of the tubular element when maximum gripping force is applied to the tubular member;

(b) actuating means for activating the gripping assemblies to extend and retract the jaws into and output of contact with the tubular element, to apply torque through the jaws about the longitudinal axis of the tubular element when the jaws contact the tubular element and to apply a gripping force to the tubular element through the jaws wherein the gripping force to the tubular element through the jaws varies substantially proportionately with the torque applied to the tubular element;

(c) a jaw link pivotally attached to said actuating means;

(d) pivoting means on one end of said jaw link for engaging said actuating means and causing said jaw link to pivot;

(e) a ball joint on the other end of said jaw link;

(f) means loosely attaching said spherical socket of said jaw to the jaw link ball joint which permits said jaw to have limited movement about said ball joint and self-adjust to provide an accurate fit with said tubular element.

54. Apparatus for gripping the surface and applying torque about the longitudinal axis of a tubular element comprising:

(a) a plurality of gripping assemblies, each including a jaw having a gripping surface mounted on the gripping assembly and adapted for movement between a retracted position which permits insertion and removal of a tubular element into and from the apparatus and an extended position which permits engagement of the jaw with the tubular element within the apparatus wherein the gripping surface of the jaw has a surface area for contacting the tubular element which is sufficiently great to grip the tubular element without extending the yield strength of the surface of the tubular element when maximum gripping force is applied to the tubular member;

(b) actuating means for activating the gripping assemblies to extend and retract the jaws into and out of contact with the tubular element, to apply torque through the jaws about the longitudinal axis of the tubular element when the jaws contact the tubular element and to apply a gripping force to the tubular element through the jaws wherein the gripping force to the tubular element through the jaws varies substantially proportionately with the torque applied to the tubular element;

(c) a jaw link including a removable adapted segment which is variable in size to allow said gripping assembly to grip different sizes of tubular elements pivotally supporting one of said jaws and pivotally attached to said actuating means; and (d) pivoting means on one end of said jaw link for engaging said actuating means and causing said jaw link to pivot.

55. Apparatus for gripping the surface and applying torque about the longitudinal axis of a tubular element comprising:

(a) a plurality of gripping assemblies, each including a jaw having a gripping surface mounted on the gripping assembly and adapted for movement between a retracted position which permits insertion and removal of a tubular element into and from the apparatus and an extended position which permits engagement of the jaw with the tubular element within the apparatus wherein the gripping surface of the jaw has a surface area for contacting the tubular element which is sufficiently great to grip the tubular element without exceeding the yield strength of the surface of the tubular element when maximum gripping force is applied to the tubular member;

(b) actuating means for activating the gripping assemblies to extend and retract the jaws into and out of contact with the tubular element, to apply torque through the jaws about the longitudinal axis of the tubular element when the jaws contact the tubular element and to apply a gripping force to the tubular element through the jaws wherein the gripping force to the tubular element through the jaws varies substantially proportionately with the torque applied to the tubular element;

(c) a slot having a flat supporting surface forced on the face of the jaws;

(d) a gripping segment having a curved upper surface; and (e) means for loosely and removable attaching the arcuate griping segment in the slot for limited movement on said curved upper surface to self-adjust and provide an accurate fit with said tubular element surface.

56. Apparatus for receiving a cylindrical object with a tubular surface through an open throat and gripping said cylindrical object for rotation comprising:

(a) a body member having a gate for radial insertion of a cylindrical object;

(b) a drive ring rotatably mounted within said body member and having an opening for radial insertion of a cylindrical object;

(c) a drag ring rotatably mounted within said body member and having an opening for radial insertion of a cylindrical object;

(d) a plurality of spaced gripping assemblies slidably mounted in said drag ring for radial movement toward and away from a cylindrical object inserted into the opening in said drag ring, the rotation of said drive ring with respect to said drag ring providing said radial movement of said gripping assemblies;

(e) a plurality of jaws pivotally mounted on said assemblies defining an arcuate gripping surface of sufficient length to substantially encircle the tubular surface of the cylindrical object, each such jaw having a gripping surface area sufficiently great that the yield strength of the surface of the cylindrical object is not exceeded when maximum gripping force is applied to the cylindrical object;

(f) a crosshead for radial movement within the drag ring;

(g) a jaw adapter having a ball joint on one end and a male connector at the other;

(h) an opening in said crosshead for removably receiving said male connector;

(i) a spherical socket in at least one of said jaws for receiving said ball joint; and (j) means for loosely attaching the jaw adapter ball joint to said spherical socket enabling said jaw to have limited movement about said ball joint and self-adjust to provide an accurate fit with the tubular surface of the cylindrical object.

57. Apparatus for gripping the surface and applying torque about the longitudinal axis of a tubular element comprising:

(a) a plurality of gripping assemblies, each including a jaw having a gripping surface pivotally mounted on the gripping assembly and adapted for movement between a retracted position which permits insertion and removal of a tubular element into and from the apparatus and an extended position which permits engagement of the jaw with a tubular element within the apparatus;

(b) means for activating the gripping assemblies to extend and retract the jaws into and out of contact with the tubular element, to apply torque through the jaws about the longitudinal axis of the tubular element when the jaws contact the tubular element, and to apply gripping force to the tubular element which varies substantially in projection to the torque applied to the tubular element, thereby minimizing or avoiding slippage of the jaws against the tubular element; and (c) jaw engagement control means responsive to initial activation of the gripping assemblies for applying a predetermined gripping force to the tubular element through the jaws prior to application of torque to the tubular element, thereby minimizing or avoiding slippage of the jaws over the surface of the tubular member as the torque applied to the tubular element initially increases, including (i) a rotatable drag ring supporting the gripping assemblies for pivotal movement between extended and retracted positions;

(ii) a rotatable drive gear for actuating the gripping assemblies to engage, disengage and apply torque to said tubular element, said drive gear rotatable relative to said drag ring to pivot said gripping assemblies and jaws between said extended and retracted positions;

(iii) motor means for selectively rotating the drive gear;

(iv) drag ring control means coupled to said drag ring for applying an adjustable drag force thereto which prevents said drag ring from rotating until said jaws are urged against said tubular element with a predetermined radial gripping force prior to rotation of said gripping assemblies, said drag ring control means including (1) brake means responsive to the application of pressurized fluid for applying a braking force to resist rotation of said drag ring and securing said drag ring against rotation until a predetermined gripping force is applied to the tubular element by the jaws and thereafter releasing said drag ring for rotation;

(2) a supply of pressurized fluid for actuating said brake means and said drive gear motor means; and (3) brake control means including an adjustable relief valve operable to relieve the pressure of fluid applied to said brake means once the pressure supplied to the motor means exceeds a predetermined pressure corresponding to a predetermined radial gripping force applied by said gripping assemblies to said tubular element, thereby releasing the drag ring for rotation once said predetermined gripping force is applied.

58. Apparatus for gripping the surface and applying rotational torque about the longitudinal axis of a tubular element comprising:

(a) a housing;

(b) a plurality of gripping assemblies, each including a jaw having a gripping surface adapted for movement between a retracted position and an extended position in contact with the surface of a tubular element;

(c) a rotatable drag ring supporting the gripping assemblies;

(d) a drive gear carried by said housing rotatable with respect to said housing and said drag ring and adapted to actuate said gripping assemblies to engage the surface of the tubular element and apply torque thereto when rotated in a first direction and to disengage the dripping assemblies from the tubular element when rotated in the opposite direction; and (e) fluid control means which substantially prevents rotation of said drag ring until a predetermined gripping force is applied to the surface of the tubular element by the gripping assemblies comprising:

(i) a fluid pump adapted to be driven by rotation of said drag ring;

(ii) a fluid reservoir;

(iii) fluid lines connecting said fluid reservoir and said fluid pump; and (iv) valves in said fluid lines which prevent fluid flow from said fluid pump in a first direction until a predetermined first pressure is attained.

59. Apparatus as defined in claim 58 including valves in said fluid lines which prevent fluid flow from said fluid pump in the opposite direction until a predetermined second pressure is attained.

60. Apparatus as defined in claim 58 wherein at least one jaw includes a replaceable arcuate gripping member forming said gripping surface.

61. Apparatus as defined in claim 60 wherein the radius of curvature of the arcuate gripping member is substantially equivalent to the outer diameter of the tubular member and the lateral ends and sides of the gripping member have substantially rounded edges.

62. Apparatus as defined in claim 58 wherein said jaw is pivotally mounted on a jaw support.

63. Apparatus as defined in claim 62 including positioning means to control relative pivotal movement between said jaw and said jaw support.

* * * * *

UNITED STATES PATENT AND TRADEMARK OFFICE

CERTIFICATE OF CORRECTION

PATENT NO. : 5,172,613

DATED : December 22, 1992

INVENTOR(S) : William E. Wesch, Jr.

It is certified that error appears in the above-indentified patent and that said Letters Patent is hereby corrected as shown below:

Column 1, line 6, delete "now abandoned"

Column 6, line 12, change "2" to ---12---

Column 13, line 50, change "81" to ---281---

Column 13, line 63, change "drip" to ---grip---

Column 14, line 17, change "14" to ---104---

Column 14, line 33, change "250" to ---259---

Column 14, line 37, change "Ripe" to ---Pipe---

Column 15, line 45, delete "insert 301 (FIGS. 15"

Column 15, line 46, delete "and 16). The gripping pads 301b"

Column 17, line 31, change "claim wherein" to read

---claim 1 wherein---

UNITED STATES PATENT AND TRADEMARK OFFICE

CERTIFICATE OF CORRECTION

PATENT NO. : 5,172,613

DATED : December 22, 1992

INVENTOR(S) : William E. Wesch, Jr.

It is certified that error appears in the above-indentified patent and that said Letters Patent is hereby corrected as shown below:

Column 24, line 36, change "support" to ---supported---

Column 28, line 19, change "output" to ---out---

Column 29, line 39, change "griping" to ---gripping---

Signed and Sealed this

Twenty-eighth Day of December, 1993

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,172,613

DATED : December 22, 1992

INVENTOR(S) : William E. Wesch, Jr.

It is certified that error appears in the above-identified patent and that said Letters Patent is hereby corrected as shown below:

Column 14, line 6, change "adapted" to ---adapter---

Column 14, line 7, change "adapted" to ---adapter---

Column 28, line 66, change "adapted" to ---adapter---

Signed and Sealed this

Nineteenth Day of April, 1994

*Attest:*

*Attesting Officer*

Bruce Lehman

BRUCE LEHMAN

*Commissioner of Patents and Trademarks*